US007803466B2

(12) United States Patent
Dorsy

(10) Patent No.: US 7,803,466 B2
(45) **Date of Patent: *Sep. 28, 2010**

(54) EXPANDABLE PANEL STRUCTURES AND METHODS OF MANUFACTURING THE SAME

(76) Inventor: Sean C. Dorsy, 11000 SW. 69th Ct., Miami, FL (US) 33156

( * ) Notice: Subject to any disclaimer, the term of this patent is extended or adjusted under 35 U.S.C. 154(b) by 461 days.

This patent is subject to a terminal disclaimer.

(21) Appl. No.: 11/783,238

(22) Filed: Apr. 6, 2007

(65) Prior Publication Data

US 2007/0237923 A1 Oct. 11, 2007

Related U.S. Application Data

(60) Provisional application No. 60/789,871, filed on Apr. 7, 2006.

(51) Int. Cl.
*B21C 27/00* (2006.01)

(52) U.S. Cl. ..... 428/596; 428/134; 428/131; 428/136; 428/573; 52/635

(58) Field of Classification Search ..... 52/410, 52/412, 222, 204.69, 204.54, 109, 90.1, 670, 52/671, 673, 677, 635; 135/145; 160/136, 160/351; 428/573, 596, 587, 601, 134, 131, 428/136, 135

See application file for complete search history.

(56) References Cited

U.S. PATENT DOCUMENTS 429,095 A * 5/1890 Livingstone ..... 29/6.2
583,235 A 5/1897 McCormick
777,236 A 12/1904 Acers
834,873 A 10/1906 Curtis
1,506,296 A * 8/1924 Forsyth ..... 52/671
1,704,608 A 3/1929 Humphris
2,018,085 A 10/1935 Otte
2,290,842 A * 7/1942 Bush ..... 428/583
2,520,664 A 8/1950 Turner
2,639,471 A 5/1953 Neves
2,692,019 A 10/1954 Zalkind
3,256,577 A * 6/1966 Bright ..... 24/563
3,710,806 A * 1/1973 Kelly et al. ..... 135/145
3,763,616 A 10/1973 Pastorelli et al.
3,825,465 A * 7/1974 Stock ..... 428/135
3,888,056 A * 6/1975 Kelly et al. ..... 52/109
3,892,898 A 7/1975 Yasul
4,187,652 A * 2/1980 Bobrovnikov et al. ..... 52/90.1
4,452,025 A 6/1984 Lew
4,559,752 A 12/1985 Kieffer
4,580,376 A 4/1986 Vinum et al.
4,583,338 A 4/1986 Sewell et al.

(Continued)

*Primary Examiner*—Richard E Chilcot, Jr.
*Assistant Examiner*—Chi Q Nguyen
(74) *Attorney, Agent, or Firm*—Finnegan, Henderson, Farabow, Garrett & Dunner, LLP

(57) ABSTRACT

An expandable panel includes a generally planar panel portion, penetrated by several pluralities of spaced parallel cuts. The cuts include aligned sets of apertures and aligned sets of transverse gaps. The panel is expandable by pulling the sides apart, separating the panel along the cuts. The positioning of the apertures and gaps causes the panel portions defined between the parallel cuts to bend apart, defining front and back planes, to which sheathing, surface panels, or "skins," can be attached. The panel can be locked in its open position by inserting connectors in adjacent aligned gaps.

36 Claims, 34 Drawing Sheets

U.S. PATENT DOCUMENTS 4,597,813 A 7/1986 Hipkins
4,669,521 A * 6/1987 Barnes et al. ..... 160/136
4,723,587 A * 2/1988 Scruggs, Jr. ..... 160/136
4,803,128 A * 2/1989 Bender ..... 428/577
4,816,310 A 3/1989 Truyens
4,866,999 A * 9/1989 Burnette et al. ..... 73/87
4,894,974 A 1/1990 Mayhew et al.
5,167,105 A 12/1992 Isban et al.
5,199,142 A * 4/1993 Davis ..... 29/6.1
5,302,466 A * 4/1994 Davis et al. ..... 428/573
5,491,950 A 2/1996 Obegi
5,651,218 A * 7/1997 Bright et al. ..... 49/490.1
5,875,609 A 3/1999 Quinif
5,992,127 A 11/1999 Quinif
6,156,444 A * 12/2000 Smith et al. ..... 428/596
6,306,522 B1 * 10/2001 Strutz et al. ..... 428/595
6,447,928 B2 9/2002 Suitts
6,532,787 B2 * 3/2003 Suitts ..... 72/185
2005/0098273 A1 * 5/2005 DeBoard, II ..... 160/136

* cited by examiner

EXPANDABLE PANEL STRUCTURES AND METHODS OF MANUFACTURING THE SAME

RELATED APPLICATION

This application claims priority to U.S. Provisional Patent Application No. 60/789,871, filed on Apr. 7, 2006, which is incorporated herein by reference.

BACKGROUND OF THE INVENTION

I. Field of the Invention

The present invention relates generally to expandable panel structures and methods of manufacturing such structures. Although not limited to a single field of use, expandable panel structures are particularly well-suited for use in the architecture and construction industries.

II. Description of the Prior Art

Conventional structural approaches in the architecture and construction industries generally include rectangular frames, each frame having generally horizontal upper and lower beams, and generally vertical end beams connecting respective distal ends of the upper and lower beams. A plurality of substantially vertical studs may be fixed to the upper and lower beams, provided at spaced intervals between the two vertical end beams. Panels or sheathing, such as sheet rock, drywall, and gypsum board, are then fixed to the combination of upper and lower beams, end beams, and studs to define an internal wall. Alternatively, materials such as siding, brick, or the like are fixed to the frame to define an external wall.

Conventional materials and construction, however, suffer from many drawbacks. For instance, construction of each frame and attachment of the studs thereto generally must be performed at the construction site. This process is slow, labor-intensive, and often subject to weather and labor problems. The process also is subject to relative imprecision in comparison to prefabricated methods. As a result, conventional construction approaches are relatively slow, expensive, and inefficient. Moreover, the volume of materials that must be shipped to the job site to build according to standard practices occupies a relatively significant amount of space in transport vehicles used for the job. The resulting number of trips required to transport all of the necessary materials to the job site further adds to the overall job time, complexity, and cost.

It would be advantageous to provide, for instance, an expandable panel construction approach that can be easily manufactured and assembled, in a modular and cost-effective manner, in any one of a limitless variety of different configurations.

SUMMARY OF THE INVENTION

The advantages and purposes of the invention will be set forth in part in the description that follows, and in part will be obvious from the description, or may be learned by practice of the invention. Moreover, the advantages and purposes of the invention will be realized and attained by means of the elements and combinations particularly pointed out in the appended claims.

One aspect of the invention provides a panel structure including a sheet of material configured to move between a nonexpanded position, where the sheet of material forms a substantially flat shape, and an expanded position, where the sheet of material forms a substantially stepped shape. The panel structure includes a first side segment formed in the sheet of material and having an outer leg and an inner leg configured to allow the first side segment to bow when the sheet of material moves from the nonexpanded position to the expanded position. The panel structure further includes a second side segment formed in the sheet of material and having an outer leg and an inner leg configured to allow the second side segment to bow when the sheet of material moves from the nonexpanded position to the expanded position. The panel structure still further includes at least one inner segment formed in the sheet of material and having a first leg and a second leg configured to allow the inner segment to bow when the sheet of material moves from the nonexpanded position to the expanded position. The panel structure still further includes at least one spacer configured to maintain the sheet of material in the expanded position.

Another aspect of the invention provides a method of forming a wall structure including providing a panel having a substantially planar portion having front and rear surfaces, right and left side edges, and first and second distal ends, with a central portion defined midway. The method includes forming a plurality of spaced parallel apertures through the panel portion from the front surface to the rear surface so as to define a pair of first and second panel surfaces facing each other. The method further includes pulling the panel in opposite directions by the right and left side edges, thereby spreading apart the panel along each cut, with the panel portions between the cuts bending apart to define front and rear planes. The method still further includes securing the panel in its expanded position and affixing sheathing to at least one of the front and rear planes of the panel.

Another aspect of the invention provides an expandable panel structure comprising a substantially planar portion having front and rear surfaces, right and left side edges, and first and second distal ends, with a central portion. The expandable panel structure includes a plurality of spaced parallel cuts penetrating the panel portion from the front surface to the rear surface. The plurality of spaced parallel cuts includes a first plurality of cuts spaced a predetermined distance apart, each cut of the first plurality of cuts extending from the first distal end to an aperture provided in the panel at a position spaced away from the central portion toward the first distal end, thereby defining a first plurality of apertures aligned with one another. The plurality of spaced parallel cuts further includes a second plurality of spaced parallel cuts, each cut of the second plurality of cuts extending from the second distal end to an aperture provided in the panel at a position spaced away from the central portion toward the second distal end, thereby defining a second plurality of apertures aligned with one another, each respective cut in the second plurality of cuts being substantially aligned with a corresponding cut in the first plurality of cuts. The plurality of cuts further includes a third plurality of cuts spaced from one another between the aligned first and second pluralities of cuts, each cut of the third plurality of cuts extending between an aperture of a third plurality of apertures and an aperture of a fourth plurality of apertures, the third and fourth pluralities of apertures being spaced inward from the first and second distal ends toward the central portion, each of the cuts defining a pair of edges that face each other. The expandable panel structure is configured to expand by moving the right and left side edges in opposite directions so as to spread apart portions of the panel along each cut and bend the panel portions between the cuts apart to define front and rear planes.

Another aspect of the invention provides a panel structure including a panel assembly having a pattern of cuts, a pattern of grooves, and a pattern of apertures. The pattern of cuts, pattern of grooves, and pattern of apertures are configured to move the panel assembly between a nonexpanded position, where the panel assembly forms a substantially flat shape, and an expanded position, where the panel assembly forms a substantially stepped shape. The panel structure further includes a support structure configured to fit within at least one of the pattern of grooves of the panel assembly and maintain the panel assembly in the expanded position.

It is to be understood that both the foregoing general description and the following detailed description are only exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION OF THE INVENTION

Reference will now be made in detail to the present embodiment of the invention, an example of which is illustrated in the accompanying drawings. Wherever possible, the same reference numbers will be used throughout the drawings to refer to the same or like parts.

Figure 1:
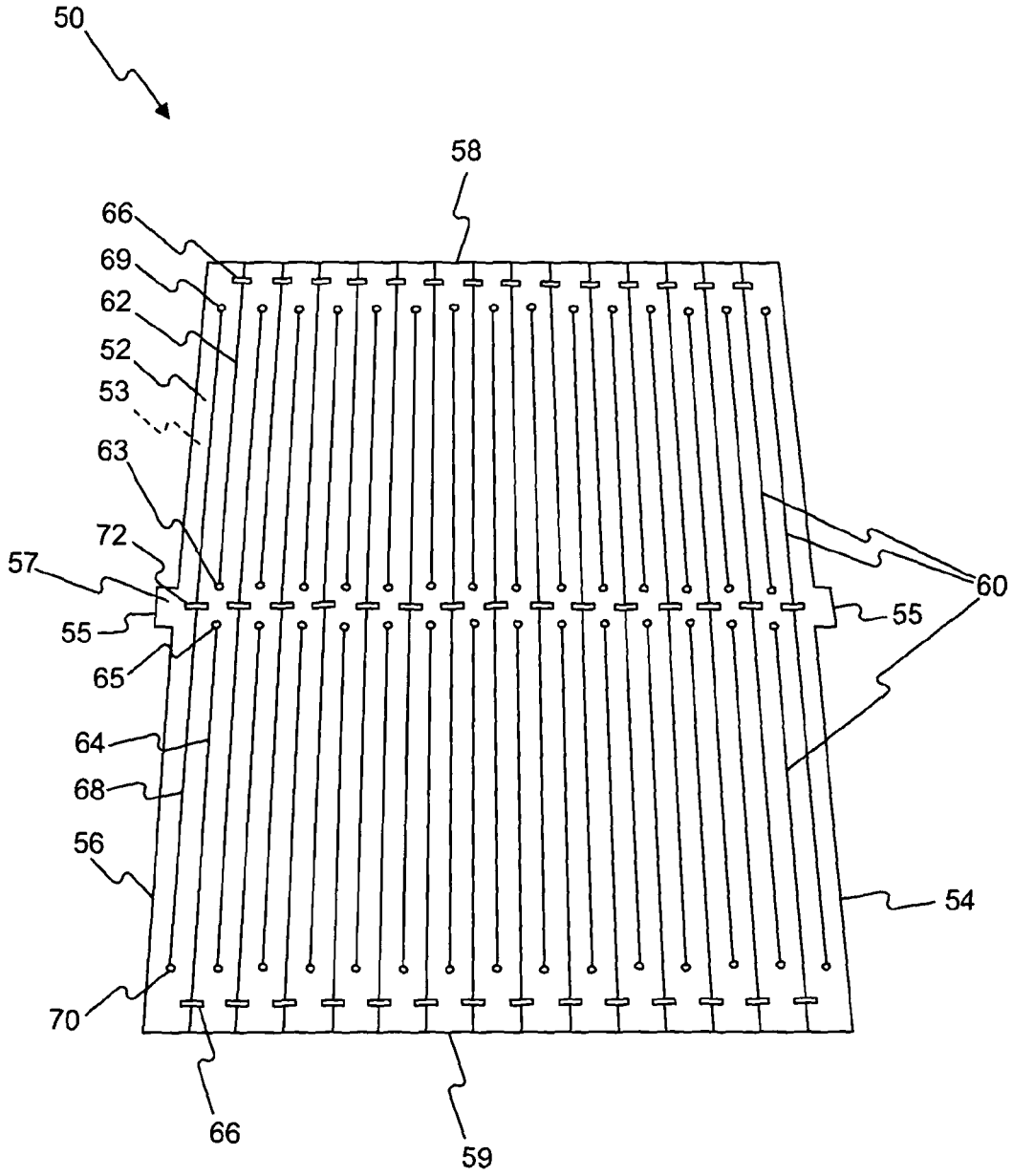
FIG. 1 is a front view of an expandable panel consistent with the present invention in a nonexpanded position, displaying the pattern of cuts.

As broadly embodied herein and referring to FIG. 1, an exemplary expandable panel 50 may preferably include a substantially planar front surface 52, a substantially planar rear surface 53 (not shown in FIG. 1), right and left side edges 54 and 56, and first and second distal ends 58 and 59. A central portion 57 may be defined midway between the first and second distal ends 58 and 59. Tab portions 55 may extend from either end of the central portion 57. In one embodiment, the tab portions 55 extend from the right and left side edges 54 and 56.

The panel 50 may preferably include a pattern of cuts 60, a pattern of apertures 63, 65, 69, 70, and a pattern of gaps 66, 72. Each pattern may penetrate through the front and rear surfaces 52, 53 of the panel 50. The pattern of cuts 60 may include a first series of generally parallel cuts 62 that may extend along a longitudinal direction of the panel 50. Each cut 62 may be spaced apart from one another by any suitable spacing so long as the panel 50 can be moved between a nonexpanded position and an expanded position.

The pattern of apertures may include a first series of apertures 63 that are spaced upward away from the central portion 57 of the panel 50. Each cut 62 may extend downward from the first distal end 58 of the panel 50 to be connected with a respective one of the first series of apertures 63. The first series of apertures 63 may be generally aligned with one another in a line parallel to the distal ends 58 and 59, and generally transverse to the side edges 54 and 56.

The pattern of cuts further may include a second series of generally parallel cuts 64, and the pattern of apertures may include a second series of apertures 65 that are spaced downward away from the central portion 57 of the panel 50. Each cut 64 may extend upward from the second distal end 59 to be connected with a respective one of the second series of apertures 65. The second series of apertures 65 may be aligned with one another in a line generally parallel to the distal ends 58 and 59, and transverse to the side edges 54 and 56.

The pattern of cuts further may include a third series of generally parallel cuts 68. Each cut 68 may be located between one of the cuts of the first and second series of cuts 62, 64. In other words, the first, second, and third series of generally parallel cuts 62, 64, and 68 may be interposed relative to one another. Each of the third series of generally parallel cuts 68 may extend between a respective one of a third series of apertures 69 and a respective one of a fourth series of apertures 70. Each of the third series of apertures 69 may be inwardly spaced away from the first distal end 58 toward the central portion 57. The third series of apertures 69 may define a row of spaced apart apertures 69 extending along a direction generally parallel to the first distal end 58 and transverse to the side edges 54 and 56 of the panel 50. Similarly, the fourth series of apertures 70 may be inwardly spaced away from the second distal end 59 toward the central portion 57. The fourth series of apertures 70 may define another row of spaced apart apertures 70 extending along a line generally parallel to the second distal end 59 and transverse to the side edges 54 and 56.

The pattern of gaps 66, 72 may include a first series of gaps 66 and a second series of gaps 72. Each of the first and second series of gaps 66, 72 may extend along a direction that is generally traverse to the longitudinal direction of the panel 50. The first and second series of gaps 66, 72 may form three rows of gaps that extend along a direction generally parallel to the distal ends 58 and 59 and a direction generally transverse to the side edges 54 and 56 of the panel 50. The first series of gaps 66 may be located at a position that is spaced inward from the distal ends 58, 59 of the panel 50 toward the central portion 57, respectively. The first series of gaps 66 also may be connected to the first series of cuts 62 and the second series of cuts 64. The second series of gaps 72 may be located in the central portion 57 of the panel 50. The second series of gaps 72 also may be connected to the third series of cuts 68. In the illustrated embodiment, each of the second series of gaps 72 is connected at a midpoint of each of the third series of cuts 68.

As will be understood by one of skill in the art, the expandable panel 50 may include any variety of additional reinforcements or cut-out features for mitigating the effects of stress, and thereby increasing the load-bearing capabilities of the panel 50. For instance, the expandable panel 50 may include reinforcing plates or reinforcing ribs located at points of relatively high stress. The expandable panel 50 also may include rounded edges, filleted interior corners, drilled apertures, or any other feature known for use in preventing fracture at points of high stress propagation, or impeding the formation of fold lines that may impede the structural integrity of the panel 50. In one embodiment, the expandable panel 50 may include stress-mitigating structures located adjacent to or around the pattern of cuts 60, the pattern of apertures 63, 65, 69, 70, and/or the pattern of gaps 66, 72. For example, in one embodiment, the expandable panel 50 may be affixed to another expandable panel 50 in a layered configuration for the purpose of providing additional load-bearing functionality. The expandable panel 50 also may be manufactured to have any particularly suitable size or shape, such as a relatively larger or smaller panel than illustrated, and may include a greater or lesser number of spaced generally parallel cuts 60, depending on the expected use and loading. For instance, the thickness of the panel 50 can be selectively increased at certain locations (e.g., adjacent to or around the pattern of cuts 60, the pattern of apertures 63, 65, 69, 70, and/or the pattern of gaps 66, 72) to improve the structural integrity of the panel 50. Moreover, the shapes and orientations of the spaced generally parallel cuts 60 may be optimized based on various stress profiles, as desired.

Figure 2A:
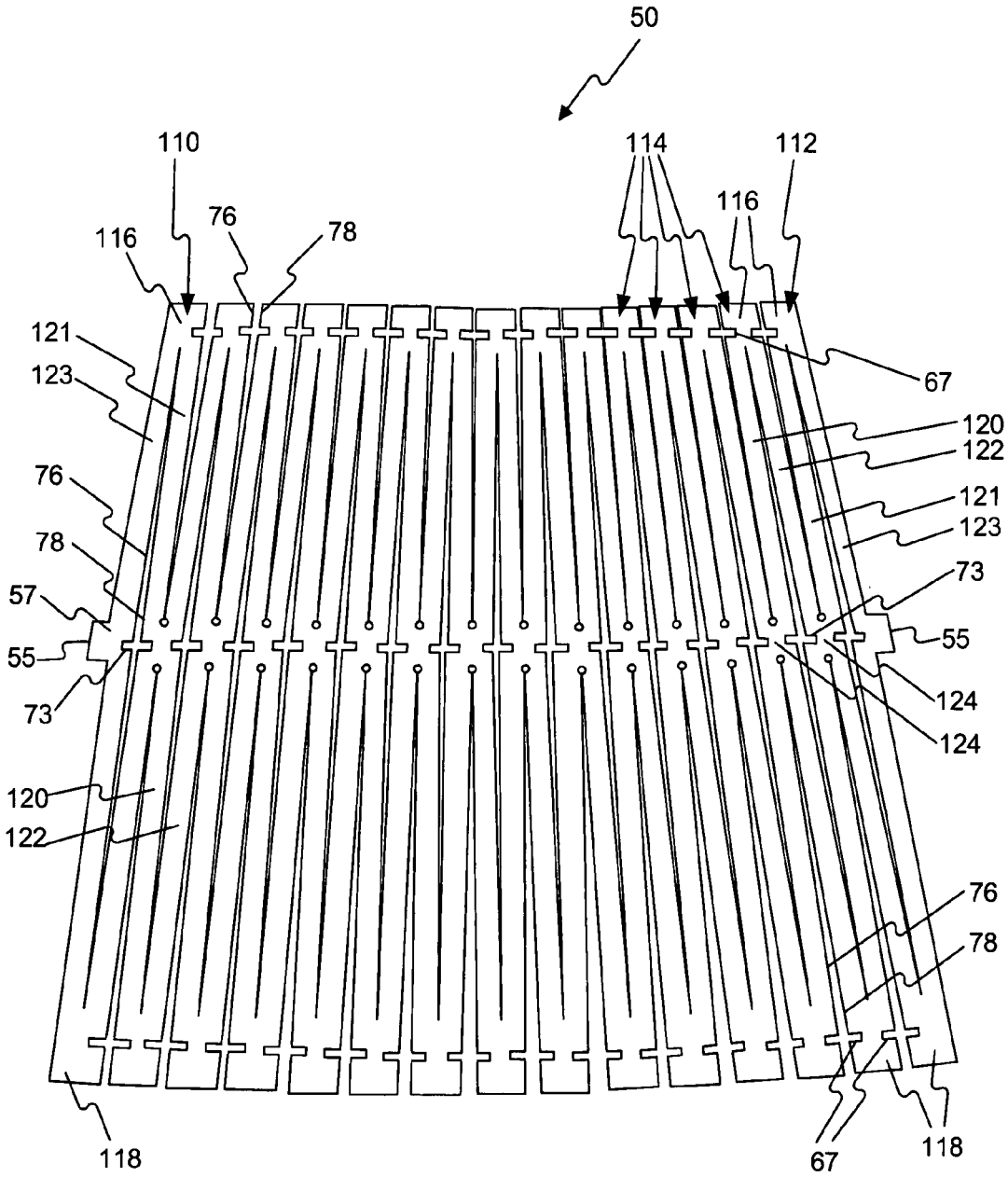
FIG. 2A is a front view depicting the expandable panel of FIG. 1 in a partially expanded position, displaying the pluralities of segments.

FIG. 2A illustrates an exemplary embodiment of the panel 50 after it has been moved to a partially expanded position. In particular, given the patterns of cuts, apertures, and gaps described with respect to FIG. 1, the exemplary expandable panel 50 may include a first side segment 110, a second side segment 112, and one or more inner segments 114 disposed therebetween. Each of the segments 110, 112, and 114 may include a first distal end joint 116 and a second distal end joint 118. Each of the first distal end joints 116 and second distal end joints 118 may include at least one groove 67 that is formed by an end portion of a respective one of the first series of gaps 66. Each of the first and second side segments 110 and 112 may include an inner leg 121 extending from a respective first distal end joint 116 to a respective second distal end joint 118, and an outer leg 123 extending from a respective first distal end joint 116 to a respective second distal end joint 118. Each of the inner segments 114 may include a first leg 120 extending from a respective first distal end joint 116 to a respective second distal end joint 118, and a second leg 122 extending from a respective first distal end joint 116 to a respective second distal end joint 118. Each of the inner and outer legs 121, 123 and first and second legs 120, 122 may include a midpoint portion 124. Each of the midpoint portions 124 may be disposed along the central portion 57 and may have formed therein a groove 73 that is formed by an end portion of a respective one of the second series of gaps 72.

According to the embodiment of FIG. 2A, the outer leg 123 and inner leg 121 of the first side segment 110 may be joined at their ends by the corresponding first distal end joint 116 and a second distal end joint 118, respectively. The outer leg 123 and inner leg 121 of the second side segment 112 may be joined at their ends by the corresponding first distal end joint 116 and second distal end joint 118, respectively. The first leg 120 and the second leg 122 of each inner segment 114 may be joined at their ends by first and second distal end joints 116, 118, respectively.

Moreover, the inner leg 121 of the first side segment 110 may be joined to the first leg 120 of an adjacent inner segment 114 by their respective midpoint portions 124. Similarly, the second leg 122 of the adjacent inner segment 114 may be joined to the first leg 120 of a still further adjacent inner segment 114 by their respective midpoint portions 124. Finally, the second leg 122 of the inner segment that is adjacent to the second side segment 112 may be joined to the inner leg 121 thereof by their respective midpoint portions 124. This pattern of joints can be applied to virtually any number of segments.

Each of the cuts 60 of the expandable panel 50, and thus, each of the first and second legs 120, 122, and inner and outer legs 121, 123, may form at least a part of a first panel surface 76 and at least a part of a second panel surface 78. When the expandable panel 50 is in a nonexpanded position, as depicted in FIG. 2A, the first panel surfaces 76 may substantially face the adjacent second panel surfaces 78.

Figure 2B:
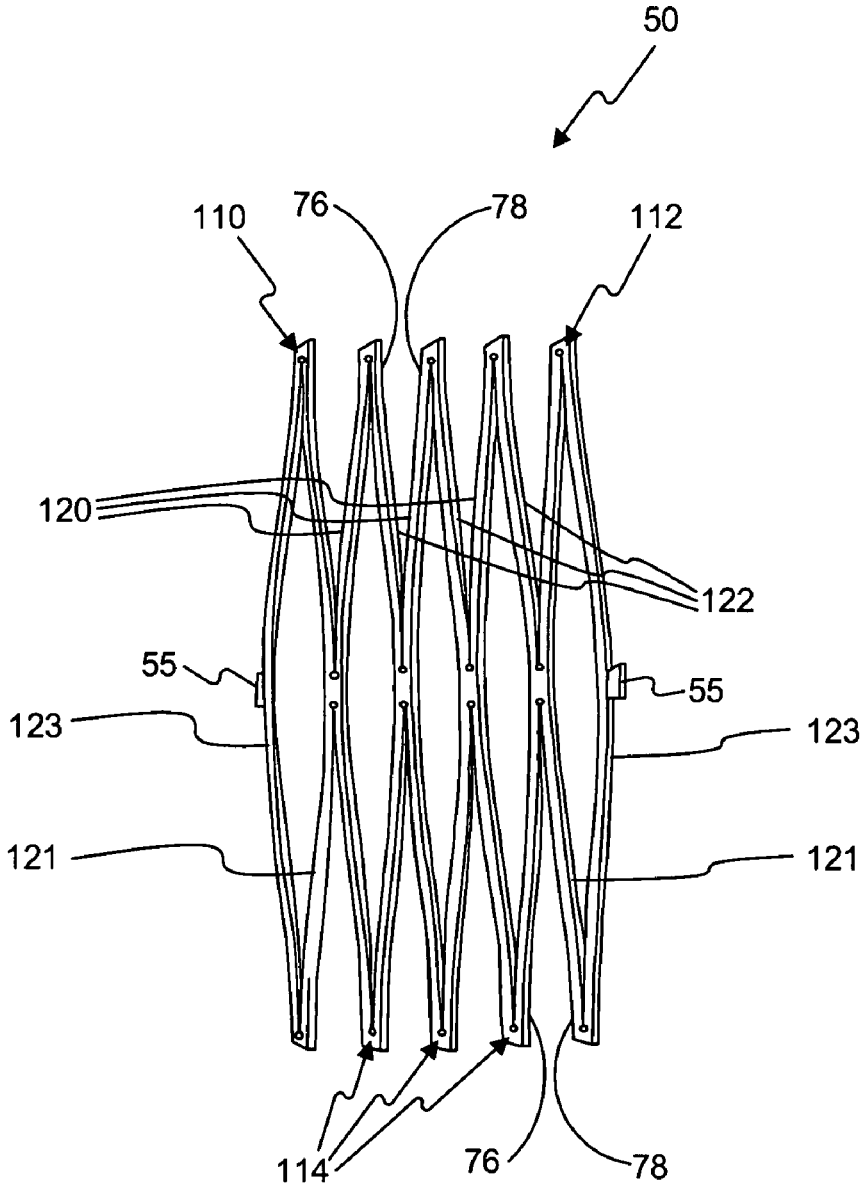
FIG. 2B is a front view depicting the expandable panel of FIG. 1 in an expanded position, displaying the pluralities of segments.

FIG. 2B depicts an exemplary embodiment of the panel 50 in an expanded position. The panel 50 may be expanded by pulling the first side segment 110 and the second side segment 112 away from each other. During assembly, the left side edge 56 of the first side segment 110 may be pulled away from the right side edge 54 of the second side segment 112 along a direction transverse to the longitudinal direction of the cuts 60. For instance, the panel 50 may be expanded by pulling the tab portions 55 in opposite directions transverse to the direction of cuts 60. Alternatively, the inner segments 114 may be sequentially pulled away from the first side segment 110, the second side segment 112, and each other inner segment 114. Accordingly, the panel 50 may expand and separate along each of the cuts 60. Because of the location and aligned orientation of the various apertures 63, 65, 69, and 70, and of the gaps 66 and 72, the first side segment 110, the second side segment 112, and the at least one inner segment 114 may each bow outward. And when the segments 110, 112, 114 bow outward, the midpoints of the two legs of each segment may separate from each other. Because the two legs of each segment are joined at their ends by respective first and second distal end joints 116, 118, and because the midpoints of the two legs of each segment bend or bow in opposite directions, the first and second distal end joints 116, 118 may be subjected to bending, compression, and/or torsional forces. Similarly, because legs between adjacent sections are joined by their midpoint portions 124, and because adjacent legs are configured to bend in opposite directions, each of the midpoint portions 124 may be subjected to bending, compression, and/or torsional forces.

As illustrated in FIG. 2B, the panel 50 in its expanded position may resemble a generally stepped configuration. In other words, each segment may appear to be stepped, one upon another. Because adjacent segments 110, 112, and 114 may be connected only at their midpoint portions 124, the resulting structure may result in previously adjacent first distal end joints 116 and previously adjacent second distal end joints 118 being spaced apart. Still further, as the segments 110, 112, and 114 bow outward, each of the transversely adjacent legs is spread apart, so as to separate the first panel surfaces 76 and second panel surfaces 78. According to some embodiments, the overall effect of the expansion of the panel 50 also may include a twisting of segments 110, 112, and 114, such that the now spread apart first and second panel surfaces 76 and 78 form front and rear planes to which sheathing and/or other inserts may be attached. In one exemplary embodiment, the resulting expandable panel 50 may be referred to as a "double zig-zag," "accordion," or "stepped" variation of the exemplary expandable panel 50. In other exemplary embodiments, connectors, spacers, or the like may be inserted into the panel 50, such as into adjacently aligned gaps, to provide structural support and/or to maintain the panel 50 in its expanded position. These assembly steps may be performed in any suitable manner, such as by hand and without the use of heavy tools or machinery.

Figure 3A:
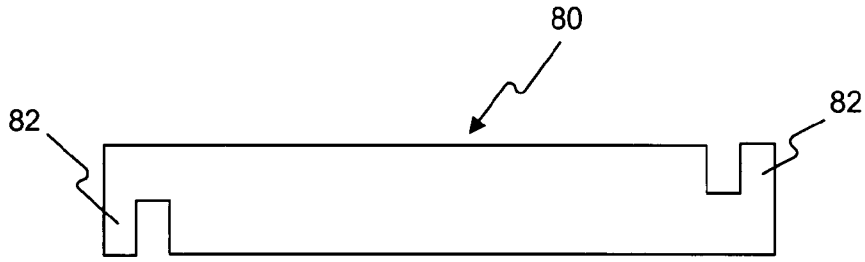
FIG. 3A is a front view of an embodiment of a connector for fixing the expandable panel of FIG. 1 in a preferably expanded position.
Figure 3B:
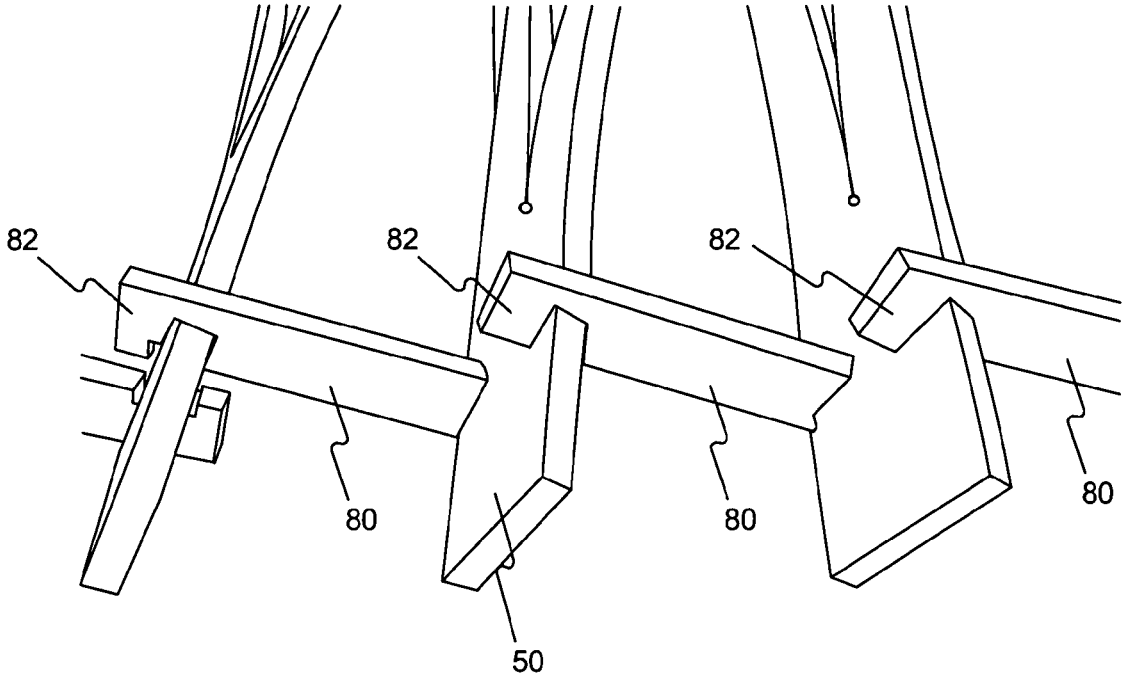
FIG. 3B is a perspective view of the expandable panel having a plurality of the connectors of FIG. 3A fixed therein.
Figure 3C:
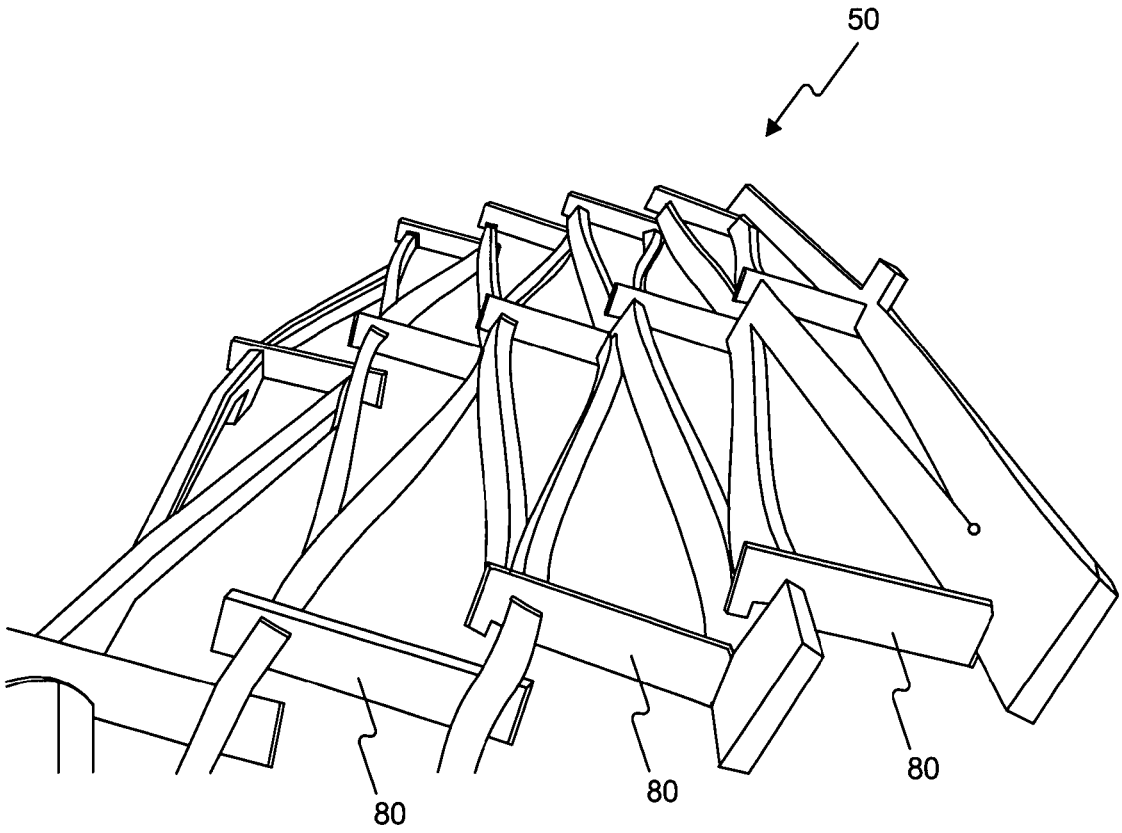
FIG. 3C is a perspective view of the expandable panel having a plurality of the connectors of FIG. 3A fixed therein.
Figure 4A:
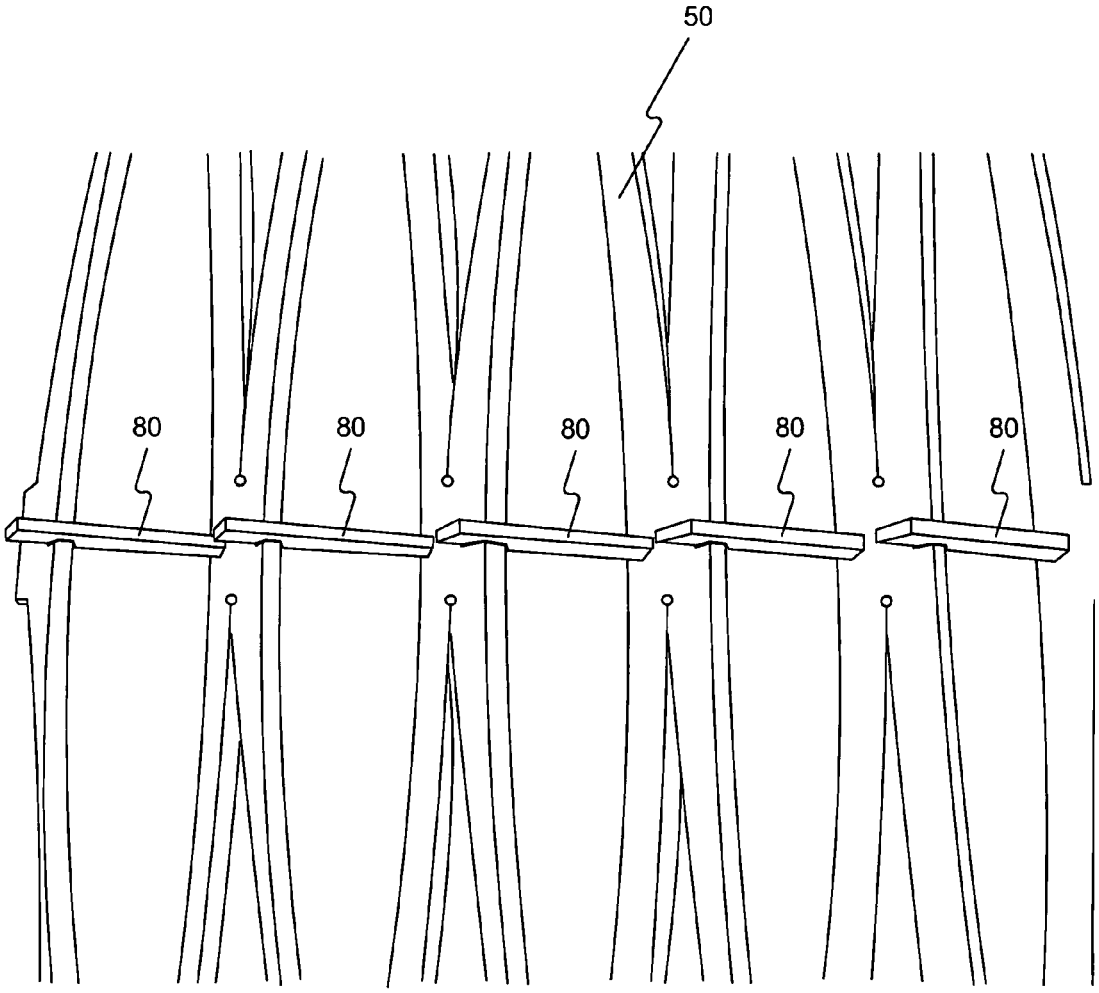
FIG. 4A is a front view of the expandable panel having a plurality of the connectors of FIG. 3A fixed therein.
Figure 4B:
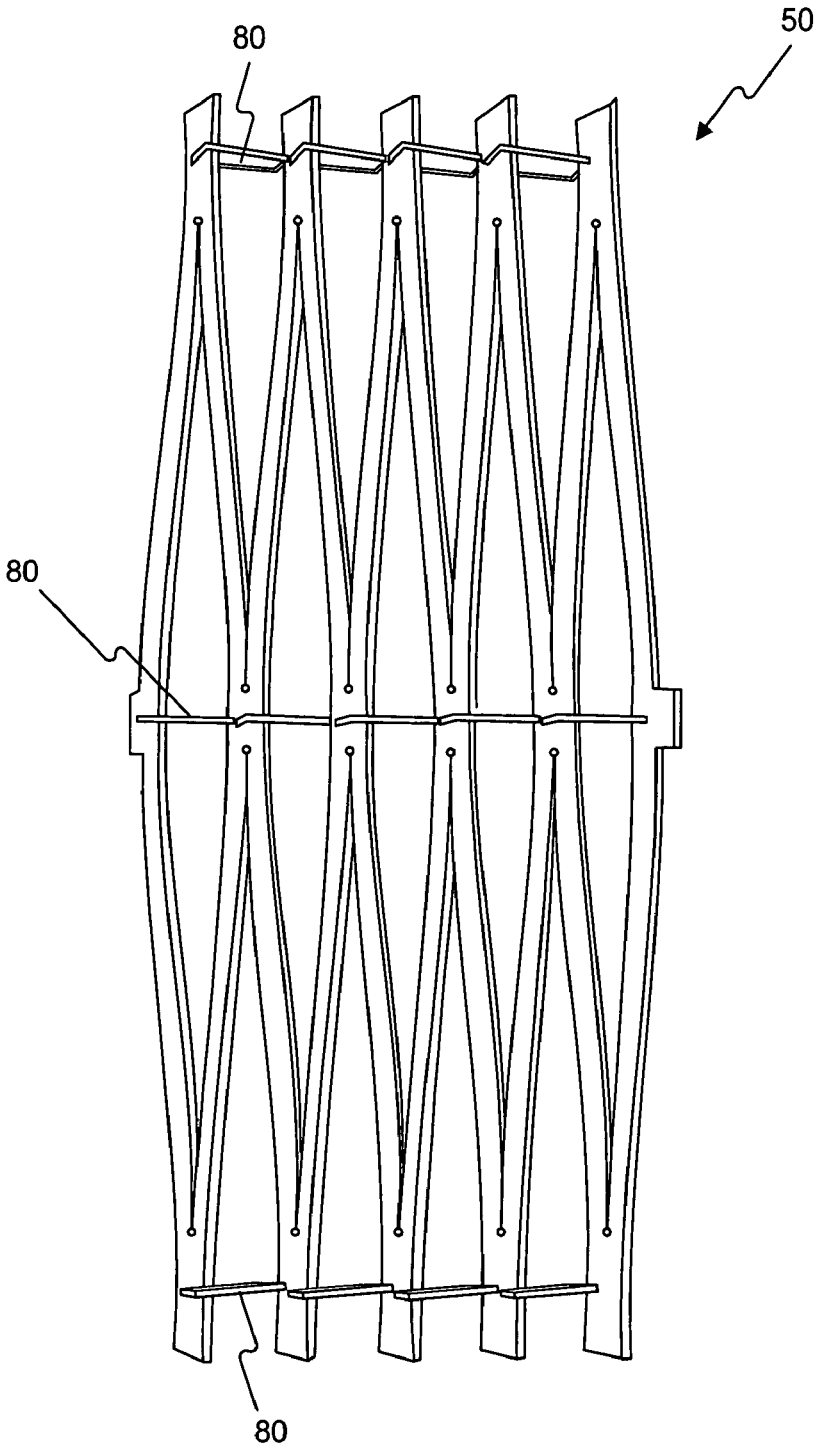
FIG. 4B is a front view of the expandable panel having a plurality of the connectors of FIG. 3A fixed therein.
Figure 5A:
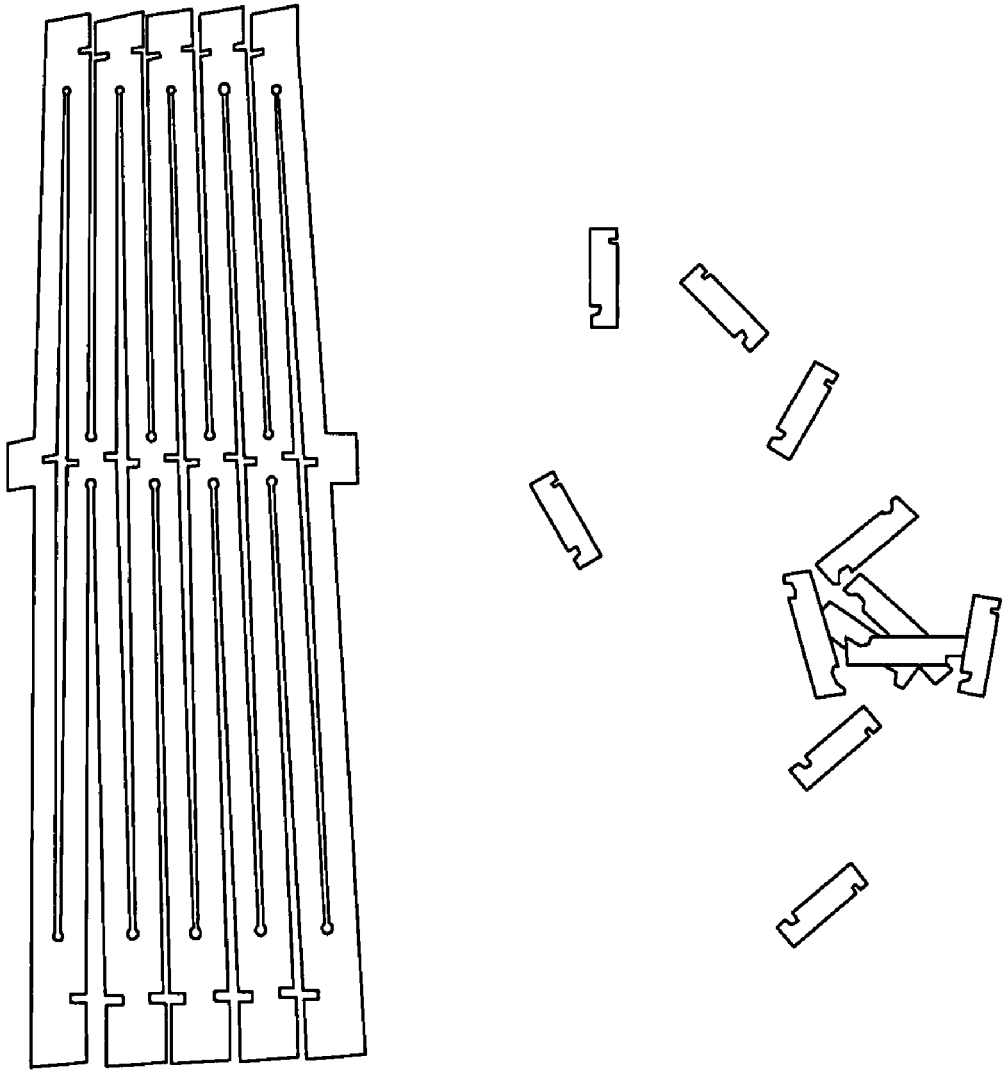
FIGS. 5A-5F depict a method of assembly of an expandable panel in accordance with the present invention.
Figure 5B:
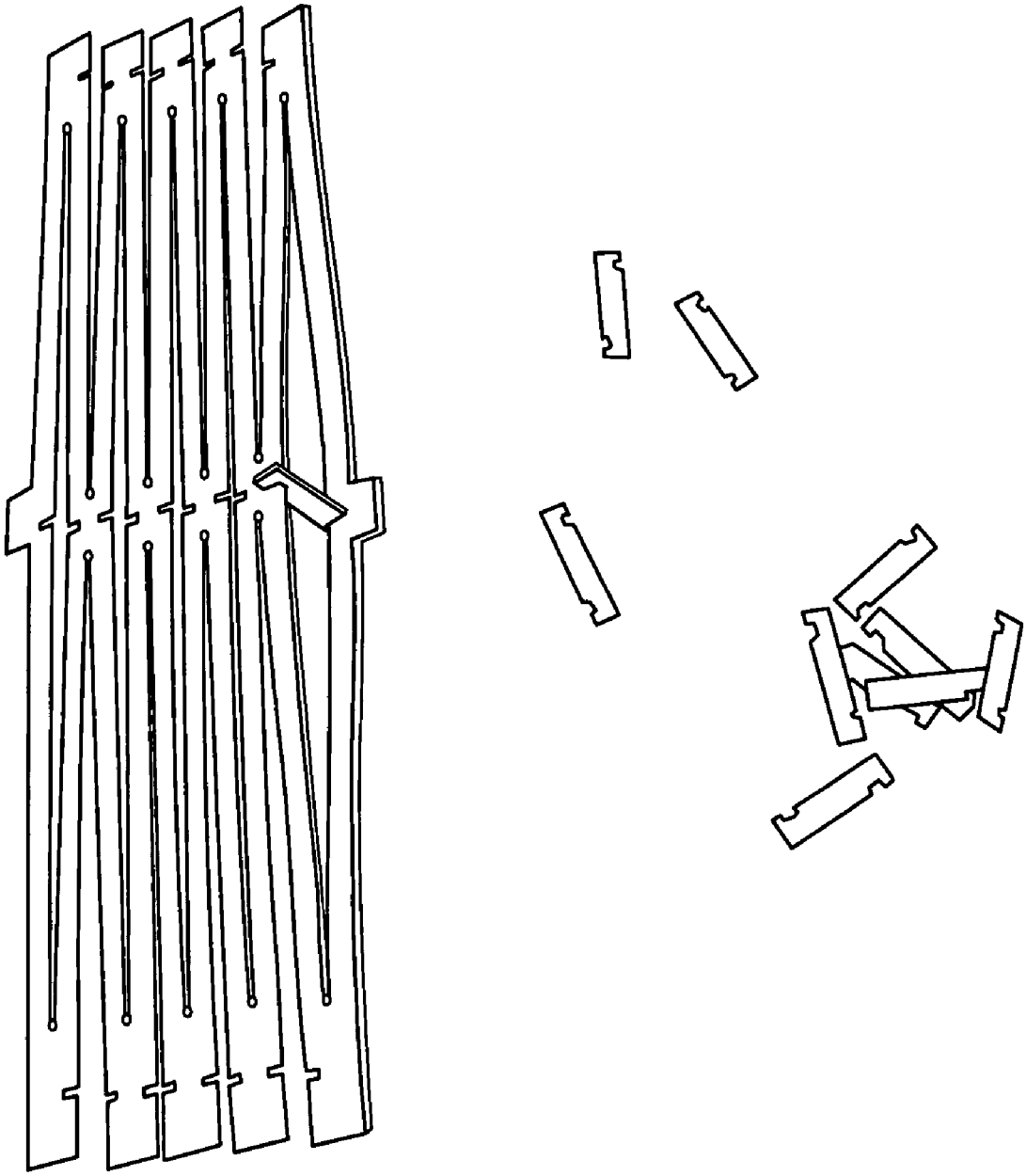
Figure 5C:
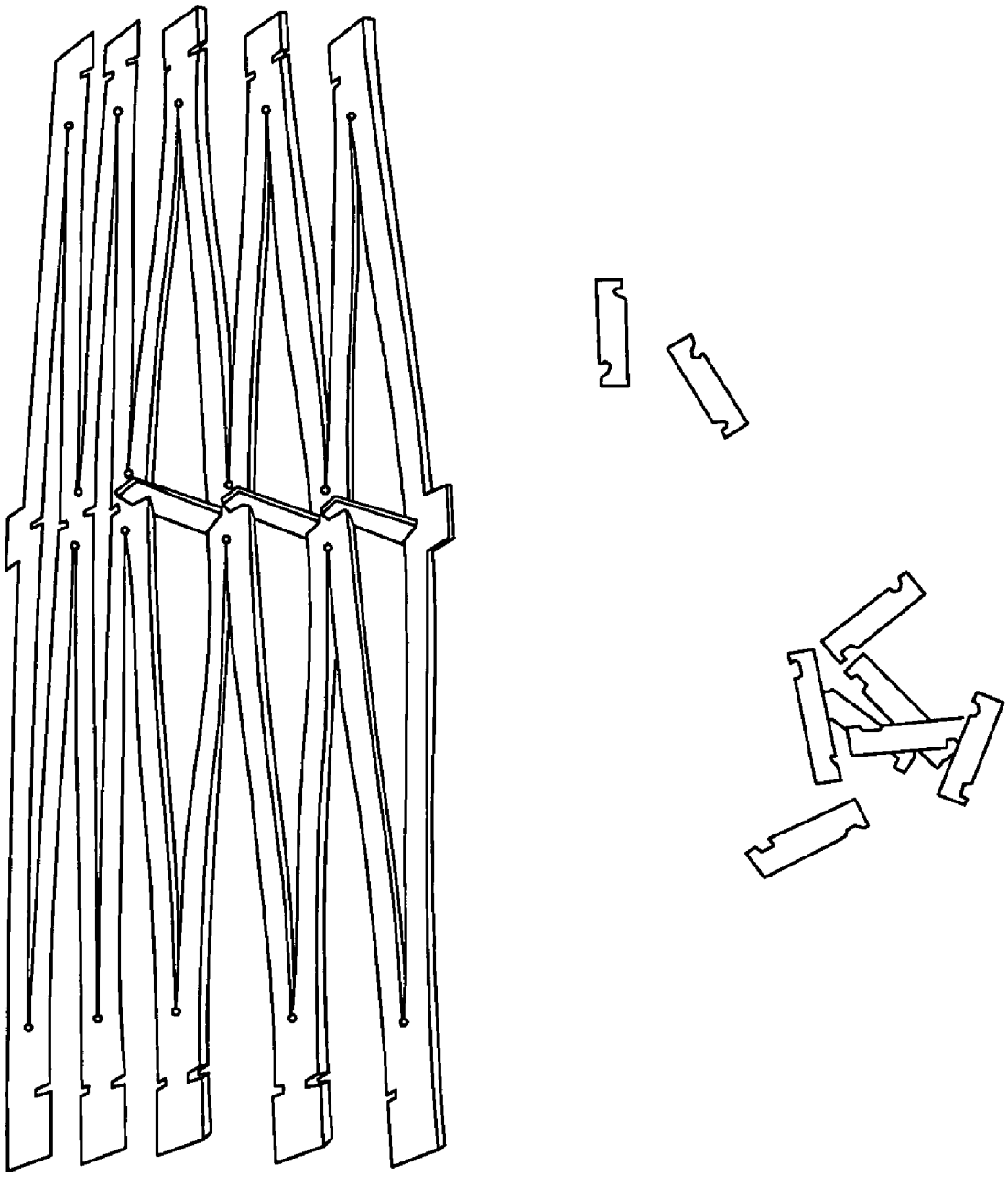
Figure 5D:
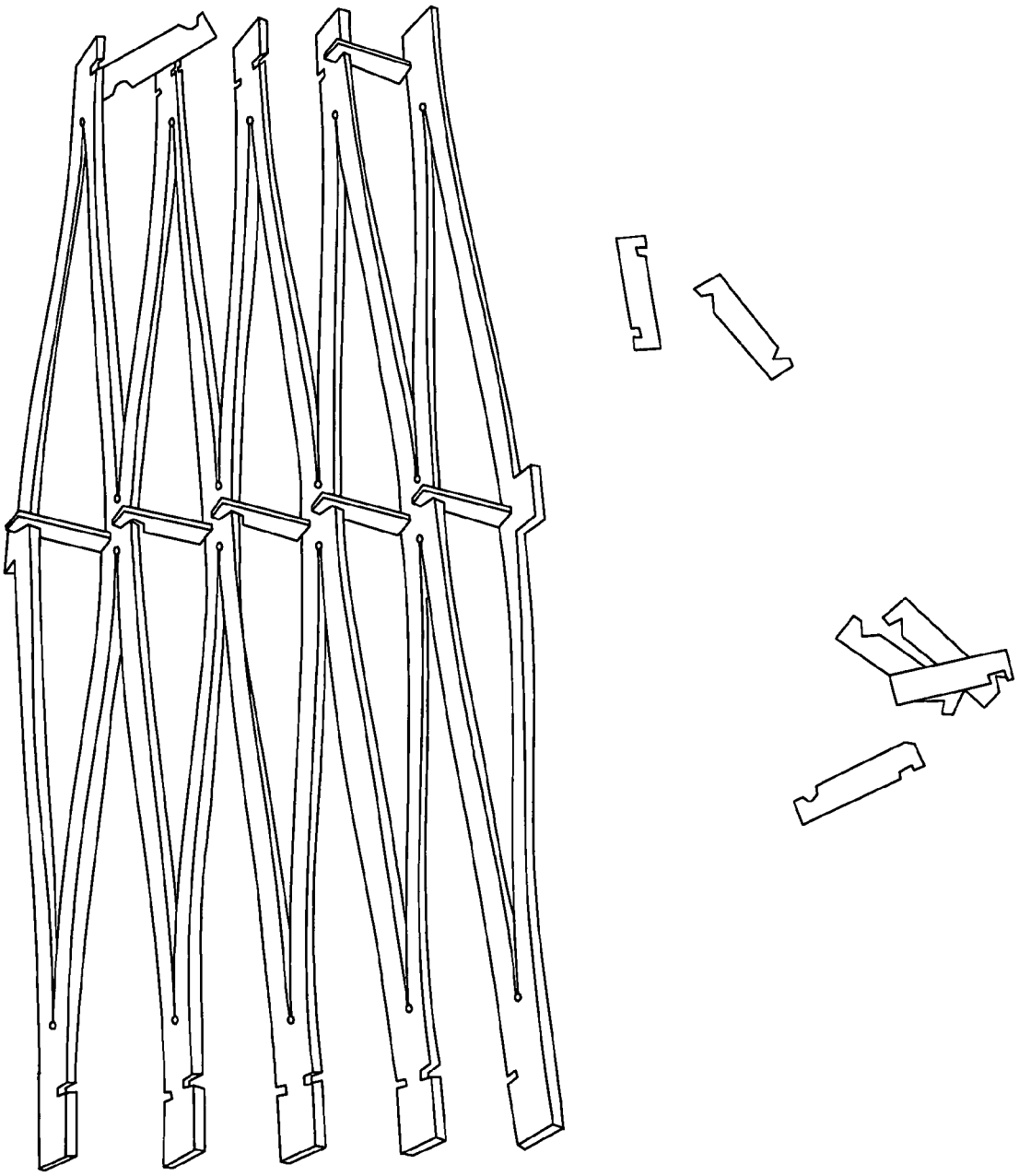
Figure 5E:
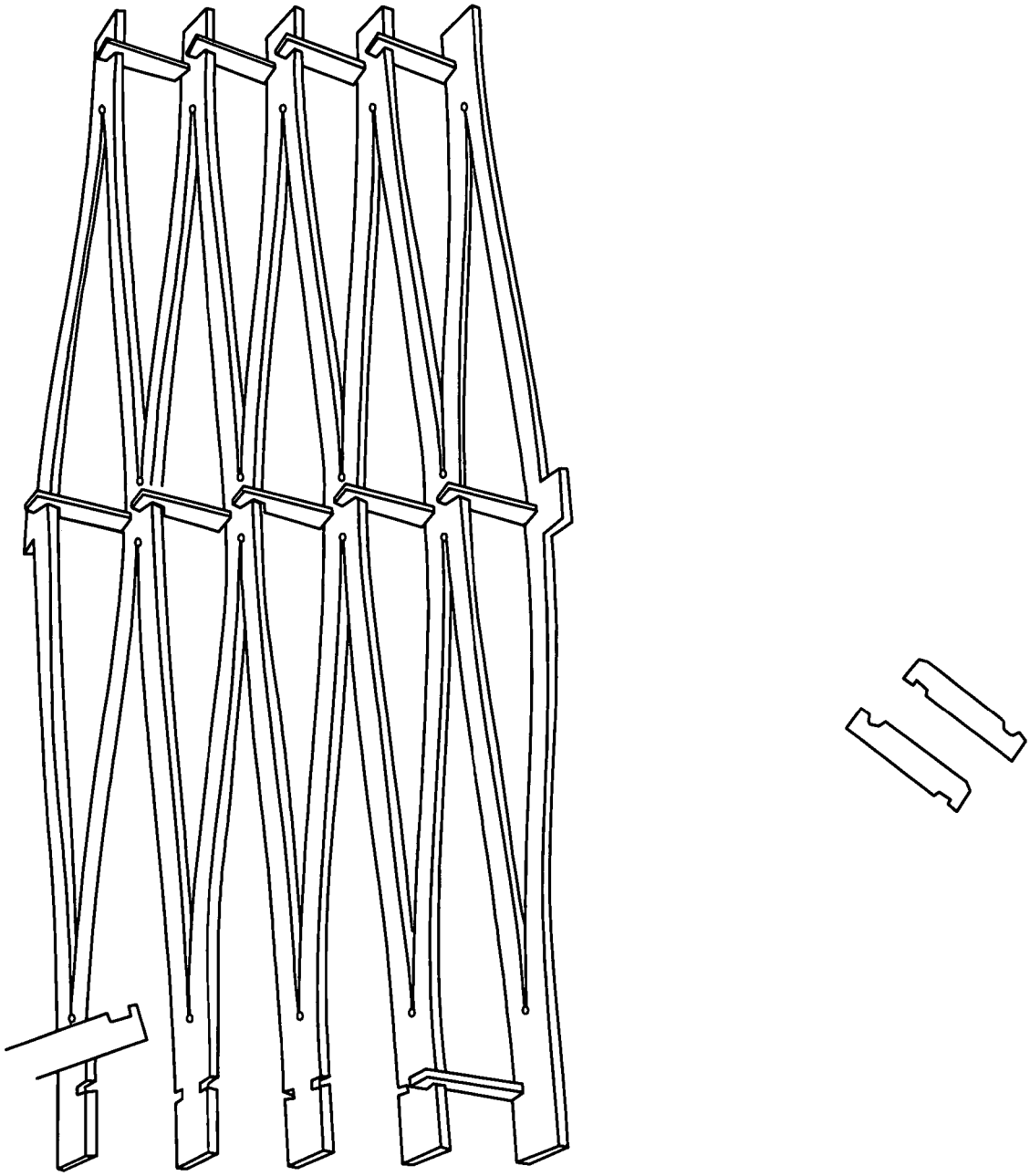
Figure 5F:
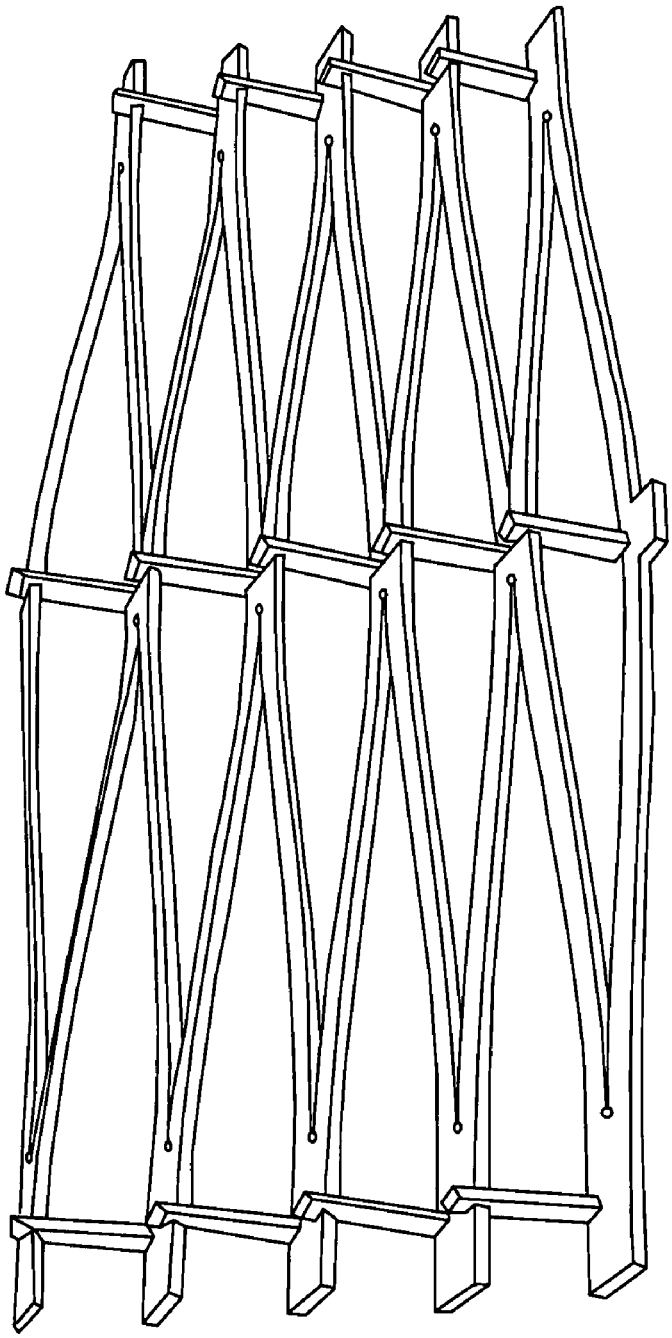

FIG. 3A depicts an exemplary embodiment of a connector 80 (alternatively referred to as a "spacer") that includes two L-shaped tabs 82. Each of the two L-shaped tabs 82 may be disposed on opposite ends and opposite faces of the connector 80. FIGS. 3B, 3C, 4A, and 4B depict additional embodiments of the connectors 80 as they are incorporated into the expandable panel 50. The connectors 80 may be fitted within different locations of the panel 50. For instance, the two L-shaped tabs 82 of a connector 80 each may be formed to fit within a respective groove 67, 73 defined by the first and second series of gaps 66, 72 in the panel 50. In one embodiment of the invention, the L-shaped tabs 82 and grooves 67, 73 may together form a mating engagement without the use of screws, fasteners, or the like. For instance, the L-shaped tabs 82 of the connectors 80 may be relatively locked into the grooves 67 and/or 73 of the panel 50. Thus, the connectors 80 may be configured to maintain the panel 50 in its expanded position and to provide rigidity and strength to the panel 50. As will be understood by one of skill in the art, each connector 80 may be made of any suitable material and configured in any suitable manner so long as it is able to withstand a plurality of compression and/or tension forces while maintaining the panel 50 in the expanded position.

FIGS. 5A-5F depict a method of assembling an exemplary expandable panel 50. Specifically, a method is depicted for expanding the panel 50 into the exemplary expanded configuration illustrated in FIG. 4B. For instance, the panel 50 may be assembled by inserting one or more connectors 80 at a time into two adjacent grooves of the grooves 67 and/or 73 until the panel 50 is fully expanded. As will be understood by one of skill in the art, specific methods for assembly relating to the sequencing of assembly, and particular methods of inserting connectors 80 into mating and/or locking engagement with the expandable panel 50 will become apparent upon practice of the invention. For instance, in one embodiment, connectors 80 may be installed into adjacent grooves 67 and then into adjacent grooves 73. Alternatively, connectors 80 may be installed into adjacent grooves 73 and then into adjacent grooves 67. In some embodiments, the connectors 80 may be further secured to gaps of panel 50 by adhesives, such as glue or solder, or by other mechanisms, such as dowel pins, hooks, or the like.

Figure 6A:
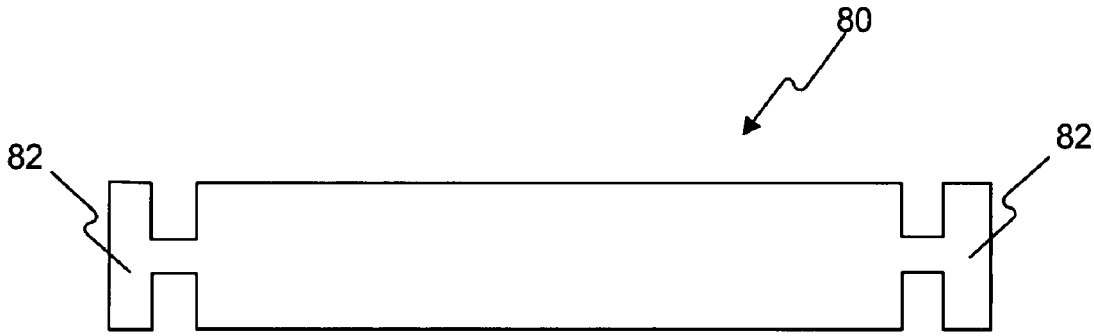
FIG. 6A is a front view of an alternative embodiment of a connector for fixing the expandable panel in an expanded position.
Figure 6B:
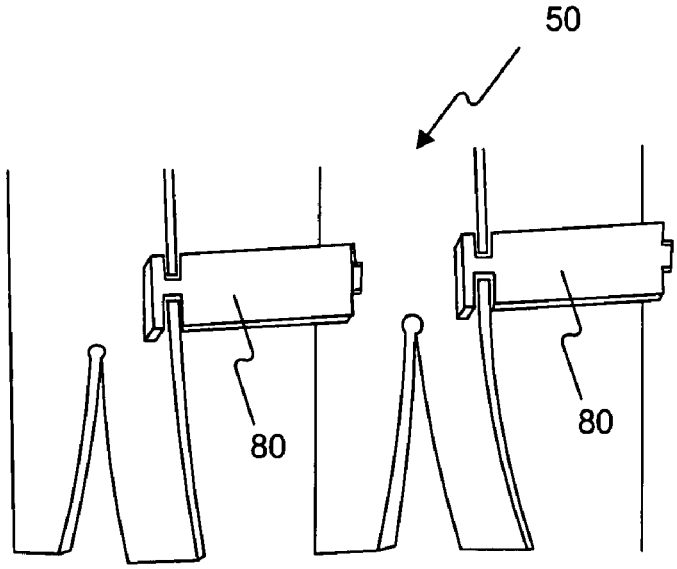
FIG. 6B is a front view of the expandable panel having a plurality of the connectors of FIG. 6A fixed therein.

FIG. 6A depicts another exemplary embodiment of a connector 80 that has T- or H-shaped tabs 82. FIG. 6B depicts an embodiment of the expandable panel 50 in which the panel 50 may be expanded by the embodiment of connectors 80 depicted in FIG. 6A.

Figure 7A:
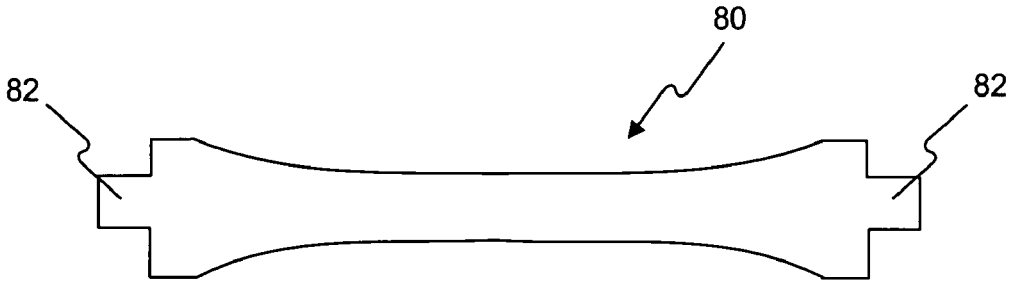
FIG. 7A is a front view of another alternative embodiment of a connector for fixing the expandable panel in an expanded position.
Figure 7B:
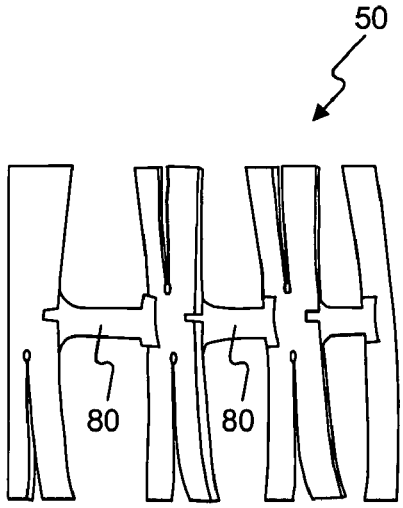
FIG. 7B is a front view of the expandable panel having a plurality of the connectors of FIG. 7A fixed therein.

FIG. 7A depicts yet another exemplary embodiment of a connector 80 that has protruding tabs 82. FIG. 7B depicts an embodiment of the expandable panel 50 in which the panel 50 may be expanded by the embodiment of connectors 80 depicted in FIG. 7A.

Figure 8A:
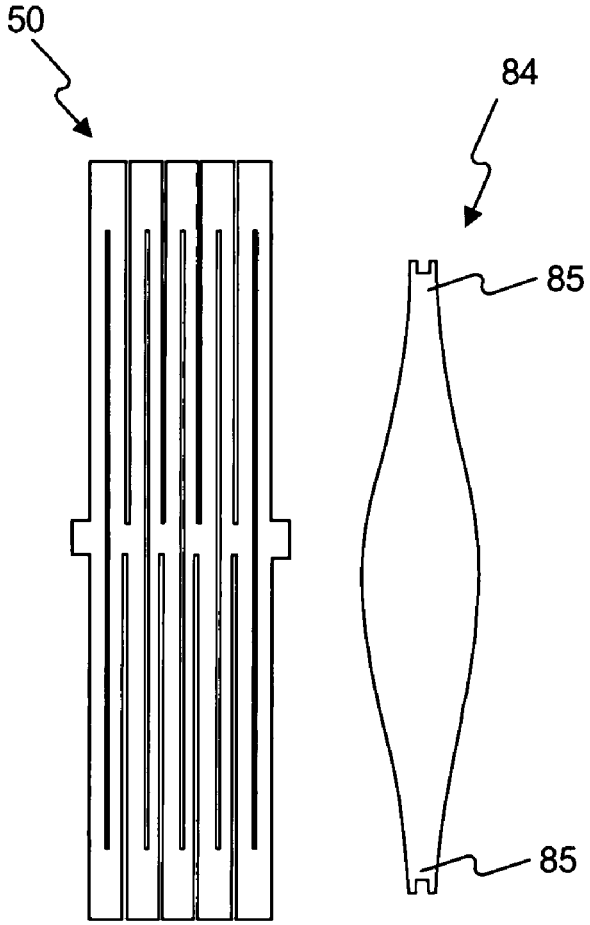
FIG. 8A is a front view depicting the expandable panel in a nonexpanded position, along with a single skin panel.

FIG. 8A depicts another embodiment of the expandable panel 50 in its nonexpanded position. FIG. 8A also depicts a single detachable skin panel 84 having U-shaped tabs 85. The skin panel 84 may be formed in any suitable shape so long as it is compatible with openings formed in an expanded panel 50. In the embodiment of FIG. 8A, the skin panel 84 may be substantially in the shape of a vesica piscis. The skin panel 84 also may be made of any suitable material known in the art. In one embodiment, skin panel 84 may be a relatively rigid panel made of wood, plastic, or metal. Alternatively, the skin panel 84 may be made of glass or another transparent material. In any of these exemplary embodiments, the U-shaped tabs 85 may be used to hold the expandable panel 50 in its expanded position. Specifically, the U-shaped tabs 85 may interlock (e.g., by tongue and groove mechanism) surfaces of the panel 50, such as the first and second panel surfaces 76 and 78, the first, second, third, or fourth apertures 63, 65, 69, 70, and/or the grooves 67, 73. In another embodiment, skin panel 84 may be a relatively flexible panel made of plastic or cloth, such as canvas. In this embodiment, a flexible skin panel 84 may be secured to expandable panel 50 by any suitable means, such as hooks, ties, adhesives, or the like. In certain embodiments, skin panel 84 may include aesthetic designs, such as pictures, manufacturers' logos, advertisements, and/or other indicia.

Figure 8B:
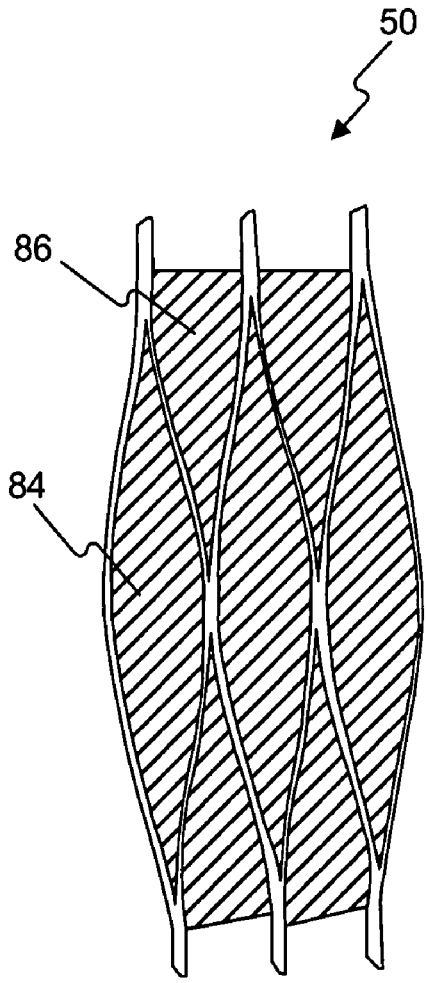
FIG. 8B is a front view depicting the expandable panel in an expanded position, with a plurality of skin panels affixed therein.

FIG. 8B depicts the expandable panel 50 as expanded by a relatively rigid embodiment of the skin panels 84. Moreover, the expandable panel 50 further includes alternative relatively rigid skin panels 86 that may be specially configured to be accommodated in partial openings of the panel 50. In this embodiment, because the skin panels 84 and 86 are relatively rigid, they may both expand and provide structural support to panel 50. Furthermore, because the skin panels 84, 86 may be formed in a suitable geometric configuration, they may be nested together in adjacent locations of a sheet of stock material, prior to manufacture, in order to minimize material waste and to ease production.

Figure 9:
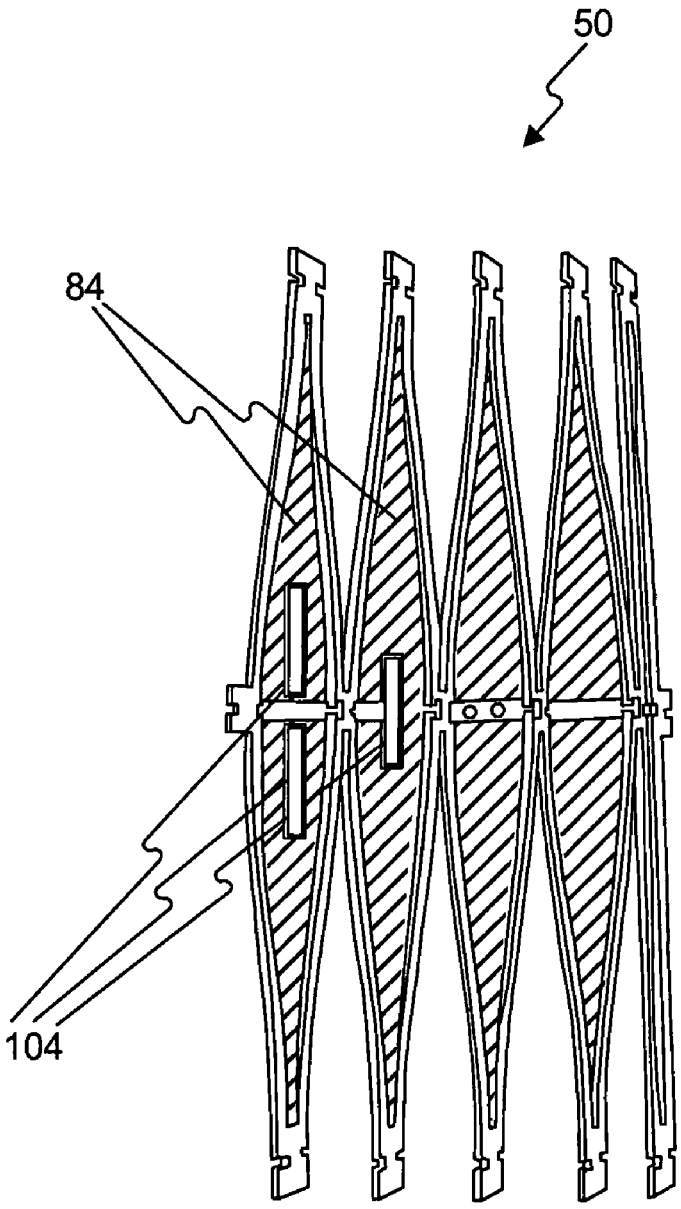
FIG. 9 is a perspective view of the expandable panel in an expanded position, with a plurality of skin panels having apertures affixed therein.

FIG. 9 depicts an embodiment of expandable panel 50 having disposed therein alternative embodiments of the skin panels 84. In particular, the skin panels 84 may include one or more apertures 104. According to one embodiment, apertures 104 may be purely aesthetic in nature. In another embodiment, apertures 104 may function to accommodate wires, pipes, insulation, plumbing, or any other structures or materials preferably extended through an interior or exterior wall. In a further embodiment, scrap material cut from the apertures 104 may be used to manufacture components, such as the connectors 80. The apertures 104 also may allow for interweaving of components, such as connectors 80, through the skin panels 84.

Figure 10A:
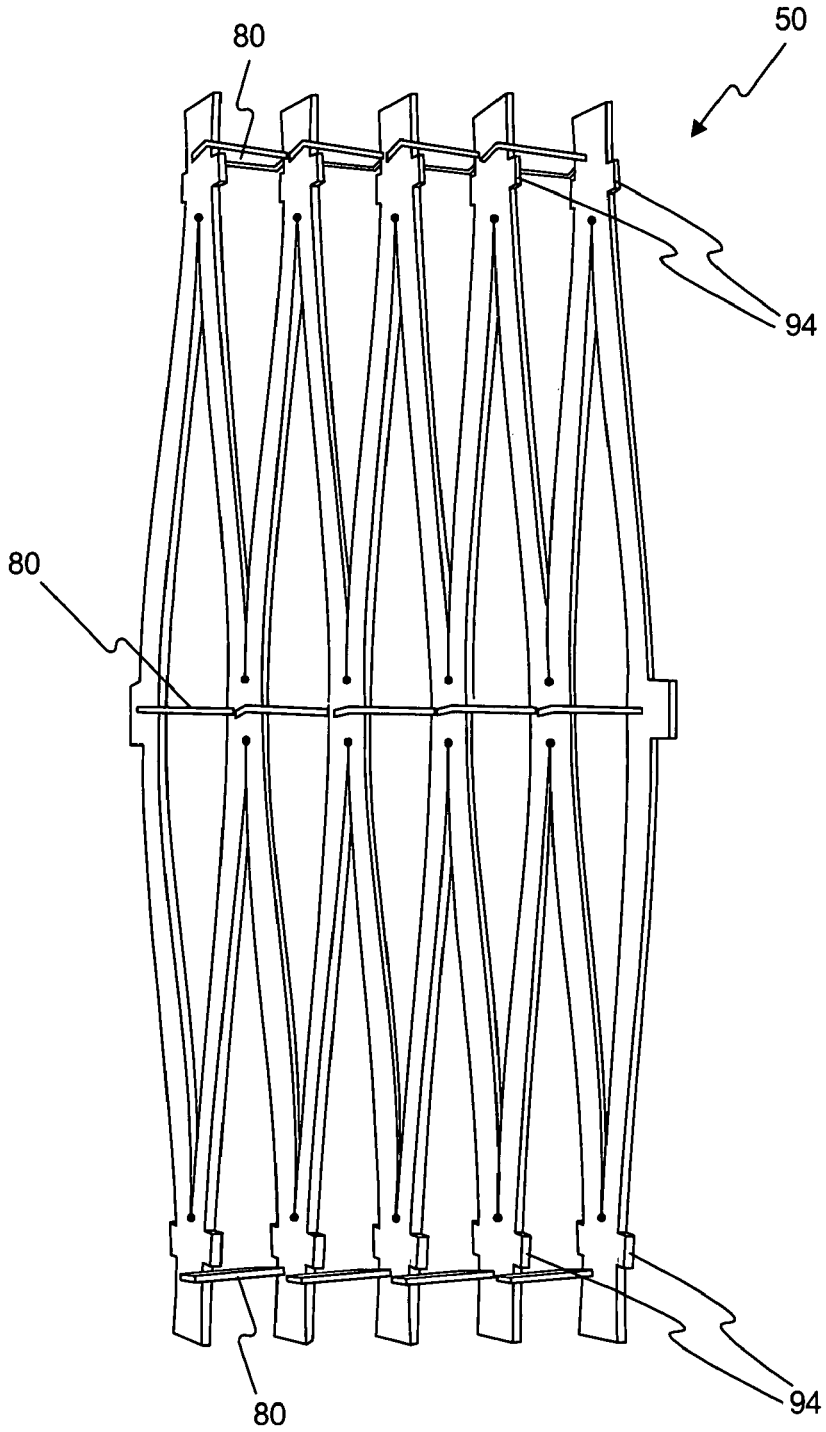
FIG. 10A is a perspective view of an expandable panel in accordance with the present invention in the expanded position and having tabs for supporting sheathing.

FIG. 10A depicts another exemplary embodiment wherein an expanded panel 50 is provided with one or more tabs 94 (alternatively referred to as "protrusions"). The tabs 94 may be used for attaching sheathing to the panel 50. The tabs 94 may be cut from the same material as that of the panel 50. For instance, the tabs 94 may extend from portions of the panel 50, such as the first panel surface 76 or second panel surface 78. The tabs 94 also may be disposed in locations of the panel 50 corresponding to mechanisms for attaching the sheathing. As a result of the change in geometry caused by the tabs 94, the pattern of cuts 60, the pattern of apertures 63, 65, 69, 70, and the pattern of gaps 66, 72 may be altered. For example, the apertures resulting between legs of adjacent segments may be wider in view of the space required for the tabs 94 to extend from the adjacent first panel surfaces 76 and second panel surfaces 78.

Figure 10B:
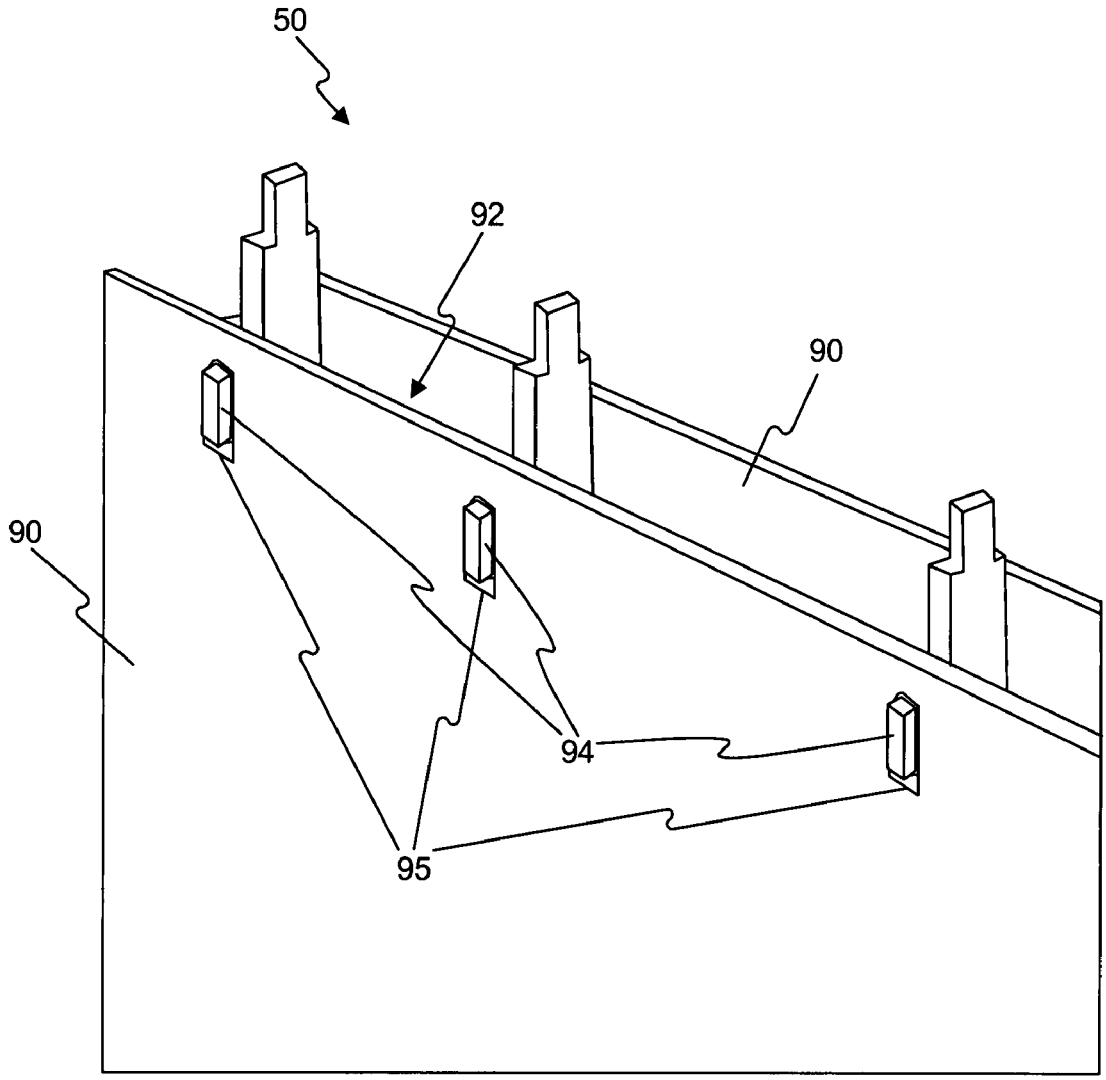
FIG. 10B is a perspective view of an expandable panel in accordance with the present invention in the expanded position and sandwiched between sheathing.

FIG. 10B depicts the exemplary embodiment wherein the expanded panel 50 is provided between sheathing 90. In this embodiment, sheathing 90 may be mounted to the expanded panel 50 by inserting the plurality of tabs 94 of the panel 50 through correspondingly disposed apertures 95 in sheathing 90. In lieu of tabs 94, the panel 50 may include another type of hook, dowel pin, clip, or other mechanism by which sheathing 90 may be sufficiently supported. For instance, in one embodiment, sheathing 90 may be mounted to the panel 50 by the tab portions 55 illustrated in FIGS. 1 and 2.

Sheathing consistent with the present invention may be manufactured from one or more of any suitable type of material. In one embodiment, sheathing 90 may include one or more of plywood, drywall, sheet rock, gypsum board, metal, cloth, foam, insulation, honeycomb, steel, or any composite material. In another embodiment, sheathing 90 may be manufactured from a transparent or translucent material, including but not limited to glass, frosted glass, and plastics such as acrylic. By this embodiment, elements of the expanded panel 50 may be angled or louvered in consideration of the directional orientation of the panel 50 relative to the sun. Accordingly, sunlight into a corresponding structure may be at least partially controlled, as desired.

Alternatively, the embodiment of FIG. 10B may be particularly suitable for constructing concrete load-bearing walls. For example, after attachment of suitably disposable sheathing 90 to the expanded panel 50, cement may be poured into a gap 92 defined between two panels of sheathing 90 and allowed to set. In one embodiment, the interior faces of sheathing 90 may be embossed or otherwise three-dimensionally disposed with indicia, such as patterns, corporate names, logos, advertisements, or specifications. Accordingly, concrete set therein may include such indicia upon removal of the sheathing 90. If desired, segments of the panel 50 may function as built-in reinforcement for the concrete form, if so designed. Moreover, sheathing 90 may be left in place around concrete forms rather than used purely as a preform structure. Sheathing 90 also may be reusable for other cast concrete applications.

In yet another embodiment, insulation may be incorporated into gap 92 by one of several embodiments. For example, insulation may be a spray-in foam variety, such as Icynene®, which expands to fill the gap 92. Insulation may alternatively include loose fill insulation, which is installed to fill specific voids between the expandable panel 50 and sheathing 90. In one preferred embodiment, insulation may be custom, batt insulation, which is preformed to infill the particular shape created upon expansion of the expandable panel 50. Insulation may also include sheets of insulation which are installed, such as by adhesive, to the outer or inner face of sheathing 90. By such embodiments, installation of insulation may be substantially easier and more cost effective in terms of reduced man-hours.

Figure 11A:
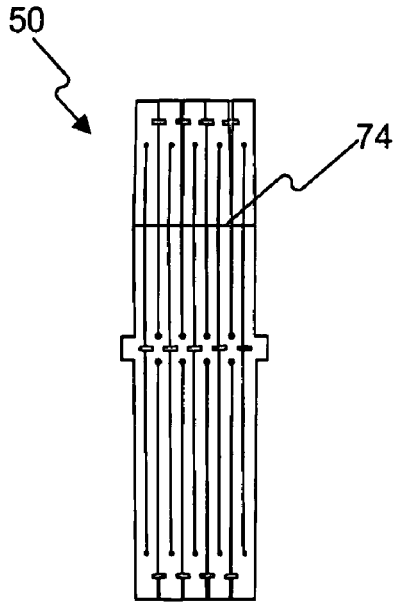
FIG. 11A is a front view of an expandable panel in accordance with the present invention, being in the nonexpanded position and having a generally horizontal crease.
Figure 11B:
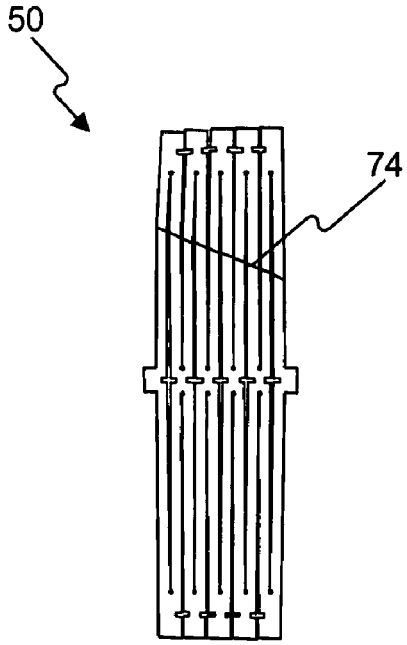
FIG. 11B is a front view of an expandable panel in accordance with the present invention, being in the nonexpanded position and having a generally diagonal crease.

FIG. 11A depicts yet another exemplary embodiment of the expandable panel 50 that has a horizontal crease (alternatively referred to as a "fold line") 74 intermediate the central portion 57 and the first distal end 58. FIG. 11B depicts yet another exemplary embodiment of the expandable panel 50 wherein the crease 74 may be diagonal instead of horizontal. Horizontal or diagonal creases 74 may allow the expandable panel 50 to be expanded into a desired overhanging panel configuration. In one embodiment, the horizontal and/or diagonal creases 74 may be staggered from one segment of the panel 50 to another in order to generate a desired form of the expanded panel 50.

Figure 11C:
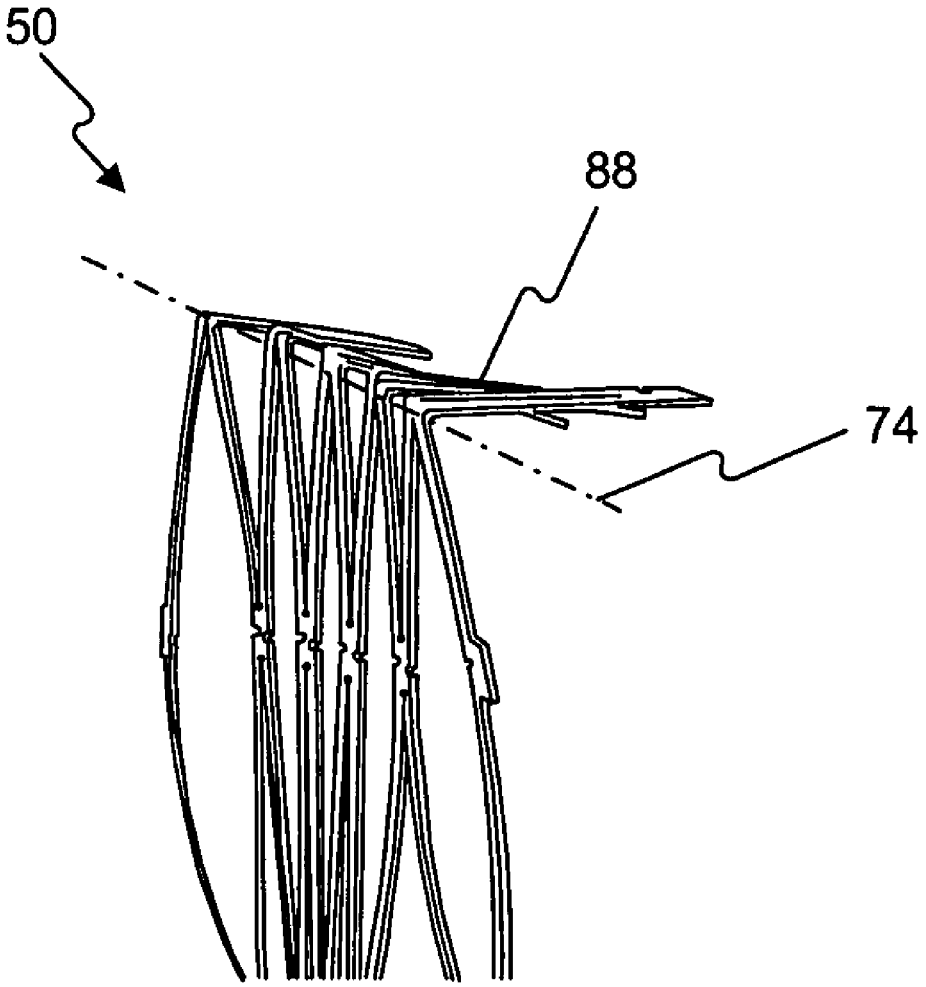
FIG. 11C is a perspective view of an expandable panel in accordance with the present invention, being in the expanded position, and having a crease and roof support members that are bent about the crease.

FIG. 11C depicts an embodiment of the expandable panel 50 in which an upper portion of the panel 50 has been bent, such as along a crease 74, to define a plurality of generally right-angle roof support members 88. As shown in FIG. 11C, the roof support members 88 may be expanded in a manner consistent with expansion of the rest of the panel 50. As will be described below, the roof support members 88 may include fixing means at distal ends of each segment for the purpose of being joined to another expandable panel 50. Alternatively, the roof support members 88 may be configured to accept any other conventional roof truss members or flooring.

Figure 12A:
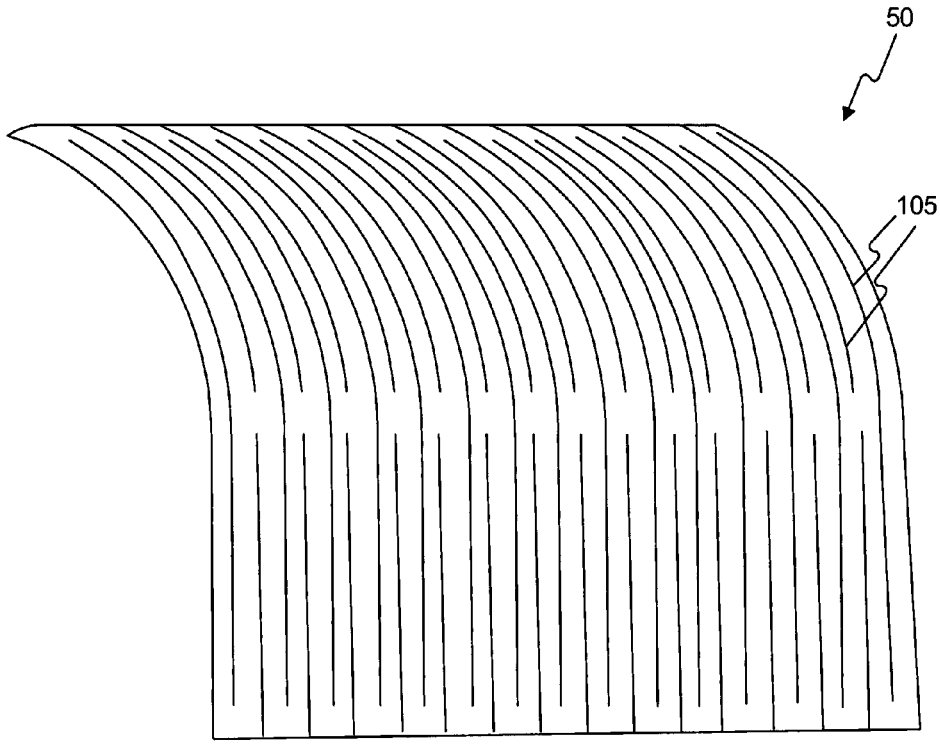
FIG. 12A is a front view of an alternative embodiment of an expandable panel in accordance with the present invention, being in the nonexpanded position and having a plurality of curved cuts.
Figure 12B:
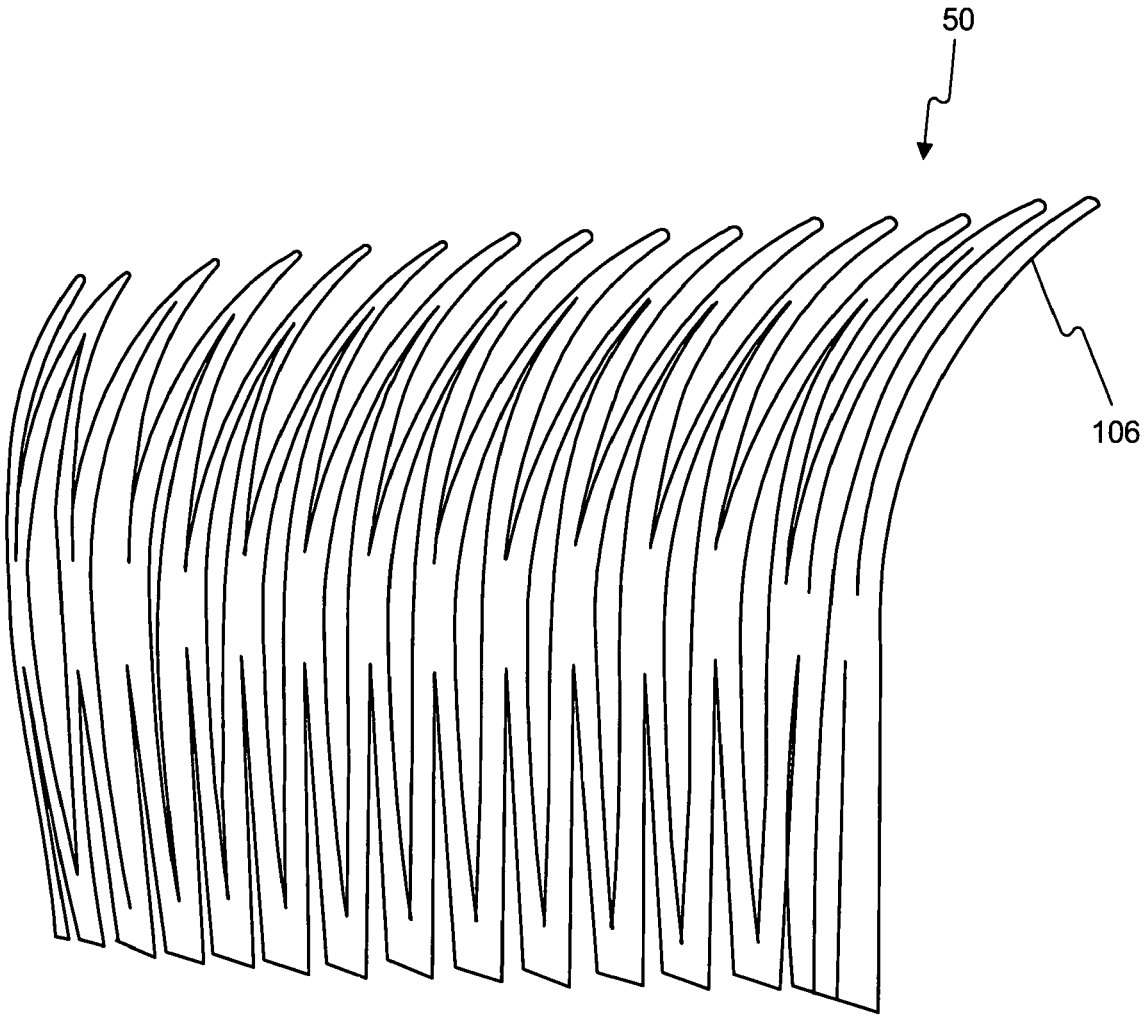
FIG. 12B is a perspective view of the alternative embodiment of FIG. 12A, being in the expanded position and forming an arched canopy.

As an alternative to bending a portion of the expandable panel 50 about a crease, the panel 50 may be manufactured to naturally form an arched canopy or roof support portion. For example, as depicted in FIG. 12A, the expandable panel 50 may be manufactured to include a curved shape having curved cuts 105. The overall shape of the expandable panel 50 and the curved cuts 105 may be particularly designed using a computer. The actual curved cuts 105 may be manufactured using conventional machines, such as computer numerical controlled ("CNC") milling machines, or more preferably by advanced manufacturing techniques such as water-jet machining or laser cutting. Accordingly, such an expandable panel 50 may be expanded to create an arched canopy 106, as shown in FIG. 12B.

Figure 13A:
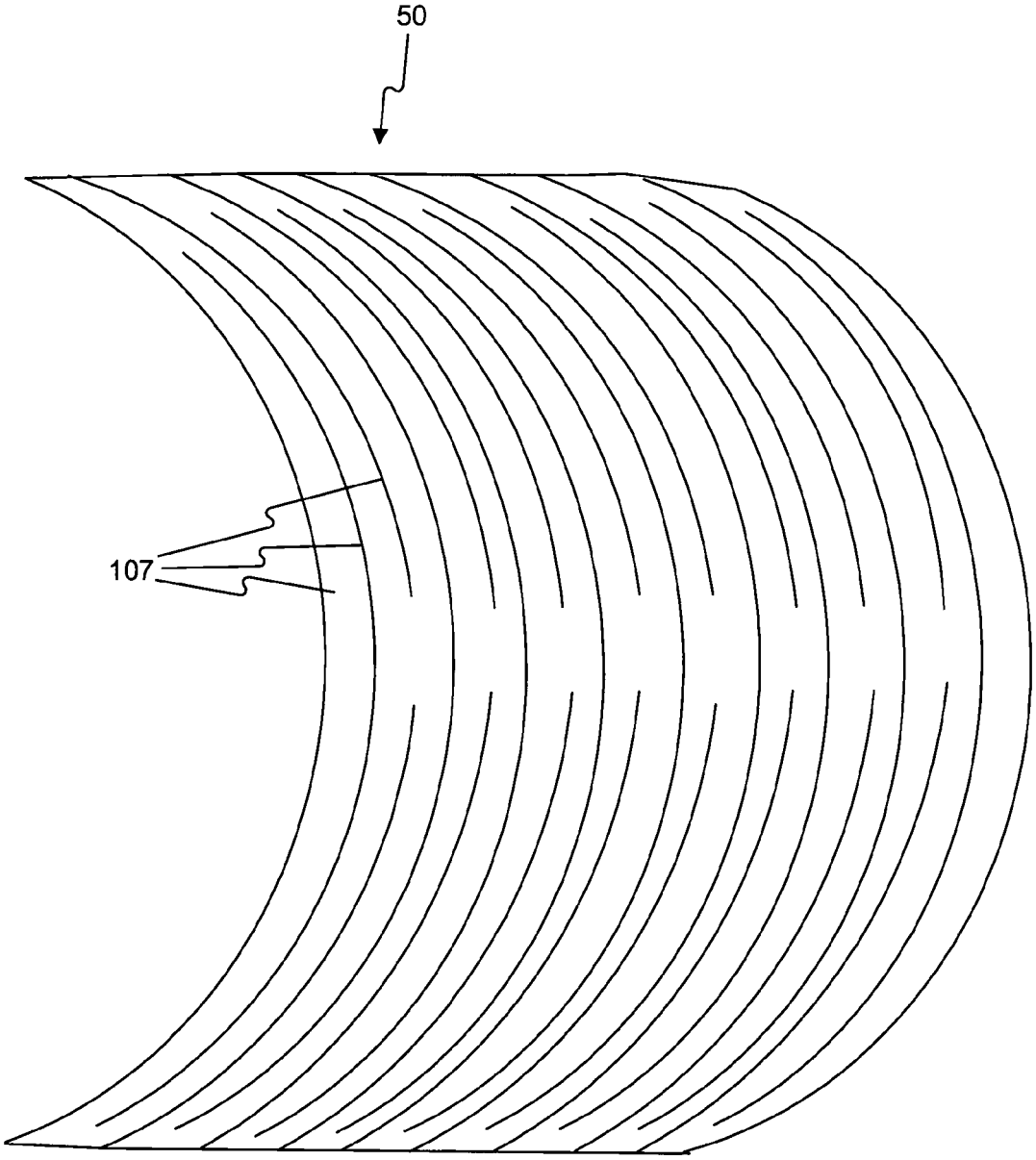
FIG. 13A is a front view of an alternative embodiment of an expandable panel in accordance with the present invention, being in the nonexpanded position and having a plurality of arched cuts.
Figure 13B:
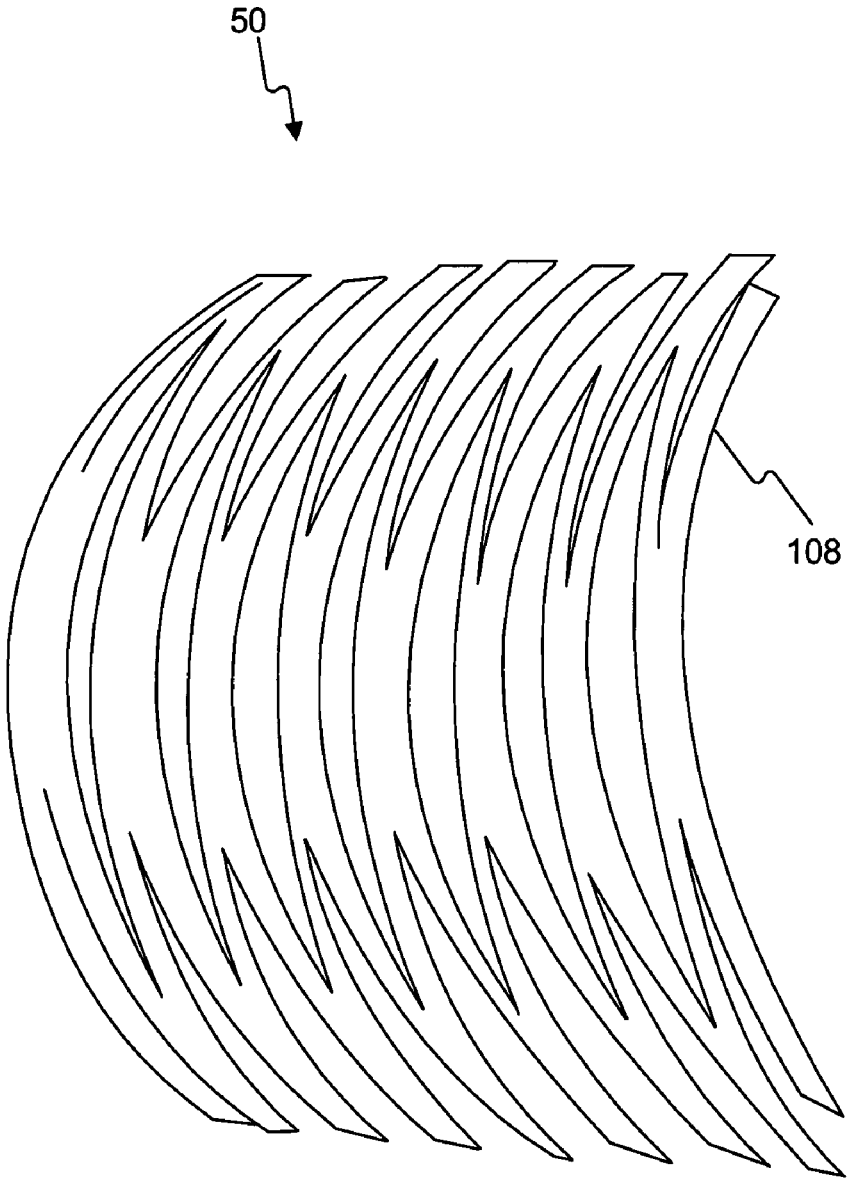
FIG. 13B is a perspective view of the alternative embodiment of FIG. 13A, being in the expanded position and forming an arch support.

FIG. 13A depicts yet another embodiment of the expandable panel 50 that includes a generally arch-shaped panel having a plurality of arched cuts 107. Accordingly, such an expandable panel 50 may be expanded to create an arch support 108, as shown in FIG. 13B. In one embodiment, the arch support 108 may be disposed in a horizontal orientation to function as a roof support, such as a barrel vault. As will be appreciated by one of skill in the art, such variations in shape of the expandable panel 50 and the plurality of spaced cuts 60, 105, or 107 therein may be altered to create the desired architectural, aesthetic, and/or load-bearing structures.

Figure 14A:
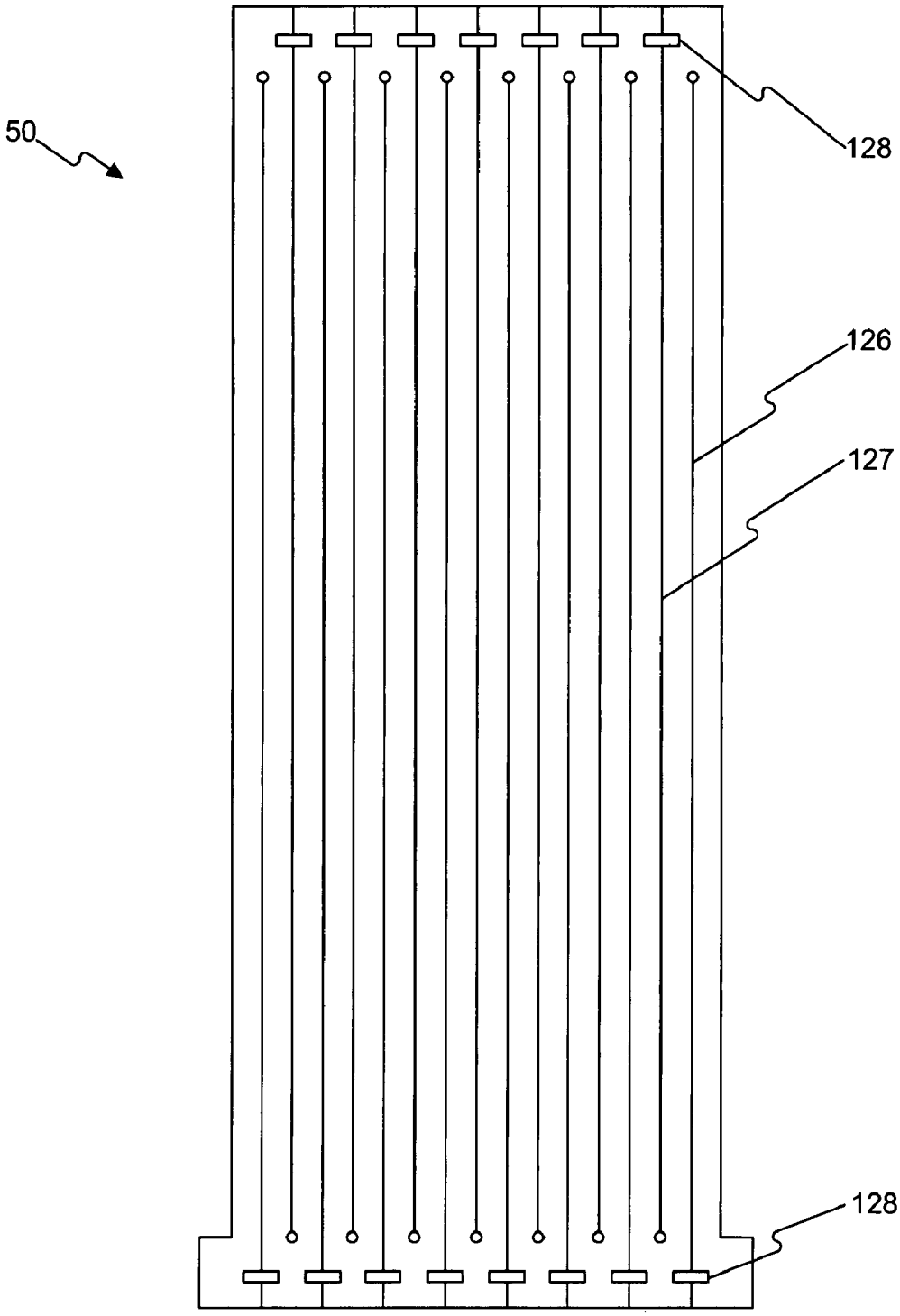
FIGS. 14A-14C are front views of alternative embodiments of expandable panels in accordance with the present invention in nonexpanded positions.
Figure 14B:
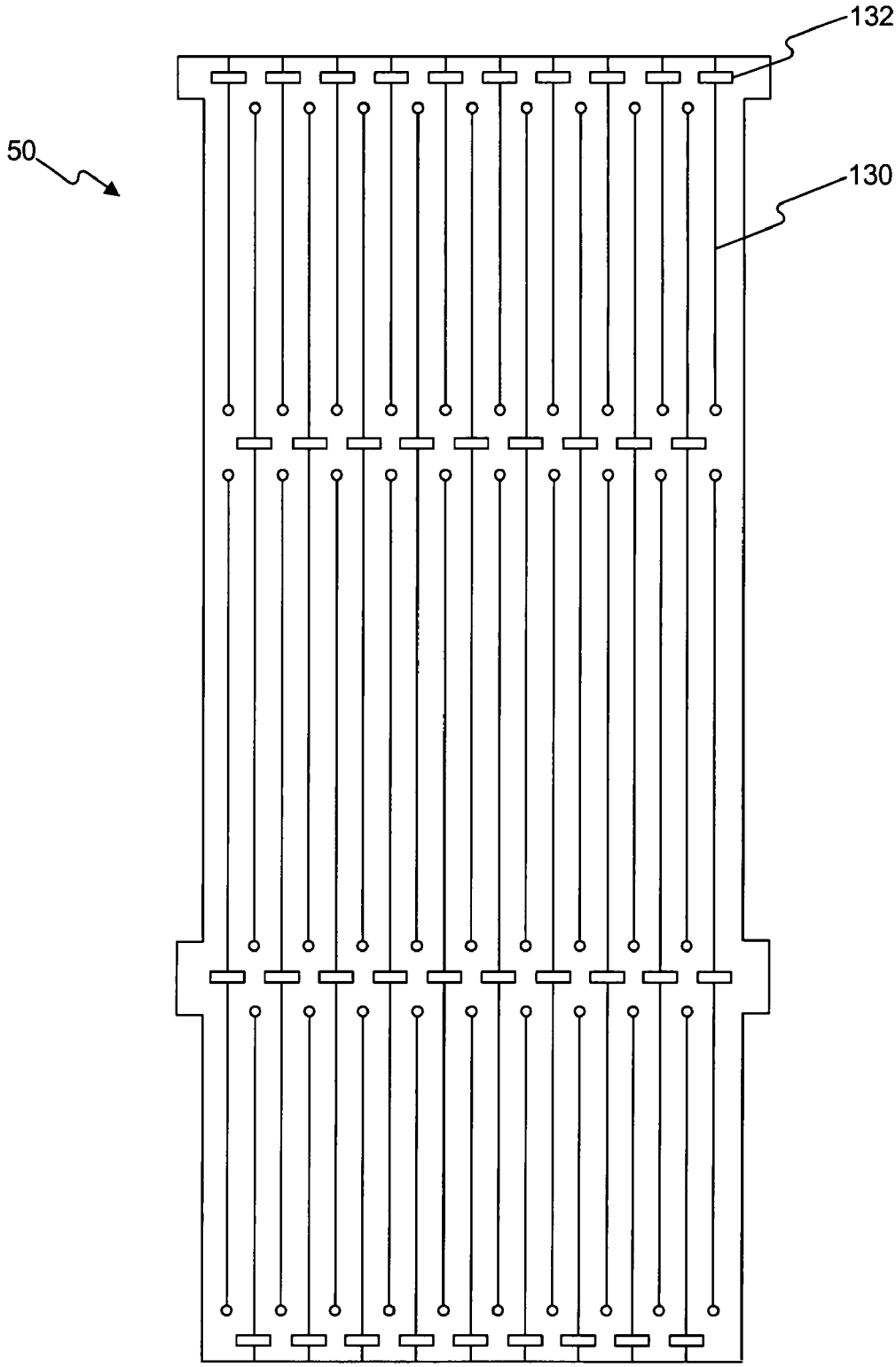
Figure 14C:
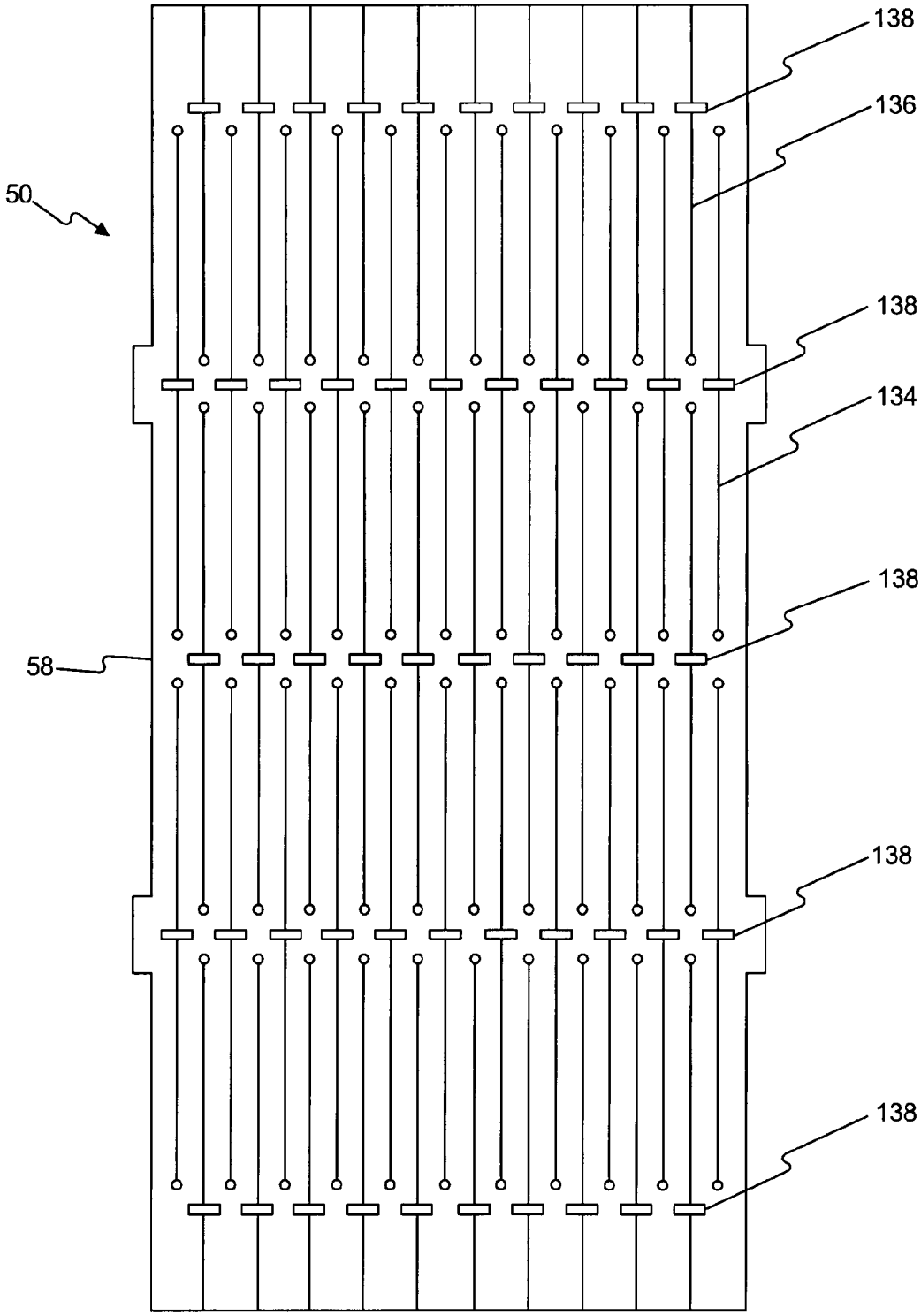

FIGS. 14A-C depict still further alternative embodiments of the expandable panel 50. For example, FIG. 14A illustrates an embodiment of the expandable panel 50 in which only two alternating series of generally parallel cuts 126, 127 may be disposed in the panel 50. Moreover, only two series of gaps 128 may be incorporated, with one line of gaps 128 being disposed at each distal end of the panel 50. Accordingly, as will be appreciated by one of skill in the art, the resulting expanded panel may be a simply alternating, stepped panel, which may be held in its expanded position by a line of connectors at each of its distal ends. This embodiment may be referred to as a "single zig-zag" expandable panel.

FIG. 14B illustrates an embodiment of the expandable panel 50 in which an additional series of generally parallel cuts 130 may be included, relative to the expandable panel 50 illustrated in FIG. 1. The expandable panel 50 also may include an additional series of gaps 132. In this embodiment, the resulting expanded panel may be similar in nature to the expanded panel of FIG. 2B but may effectively include an additional half of the panel 50 protruding from one of its distal ends. Thus, the so-called "triple zig-zag" expandable panel 50 may either be longer than those of previous embodiments, or it may have shorter parallel cuts and segments.

FIG. 14C illustrates an embodiment of the expandable panel 50 in which the expandable panel of FIG. 1 may be essentially doubled (i.e., mirrored about a distal end, such as the first distal end 58, of the panel). Therefore, the expandable panel may include two additional series of generally parallel cuts 134, 136, as well as five overall lines of gaps 138. The resulting "quadruple zig-zag" expandable panel 50 may be either longer than those of previous embodiments, or it may have shorter parallel cuts and segments. These and other variations on the particularly disclosed expanded panels 50 will become apparent to one of ordinary skill in the art upon study of the present disclosure. That is, alternative arrangements of cuts, apertures, and segments are not limited to the embodiments recited herein, and are contemplated within the scope of the present invention.

Figure 15A:
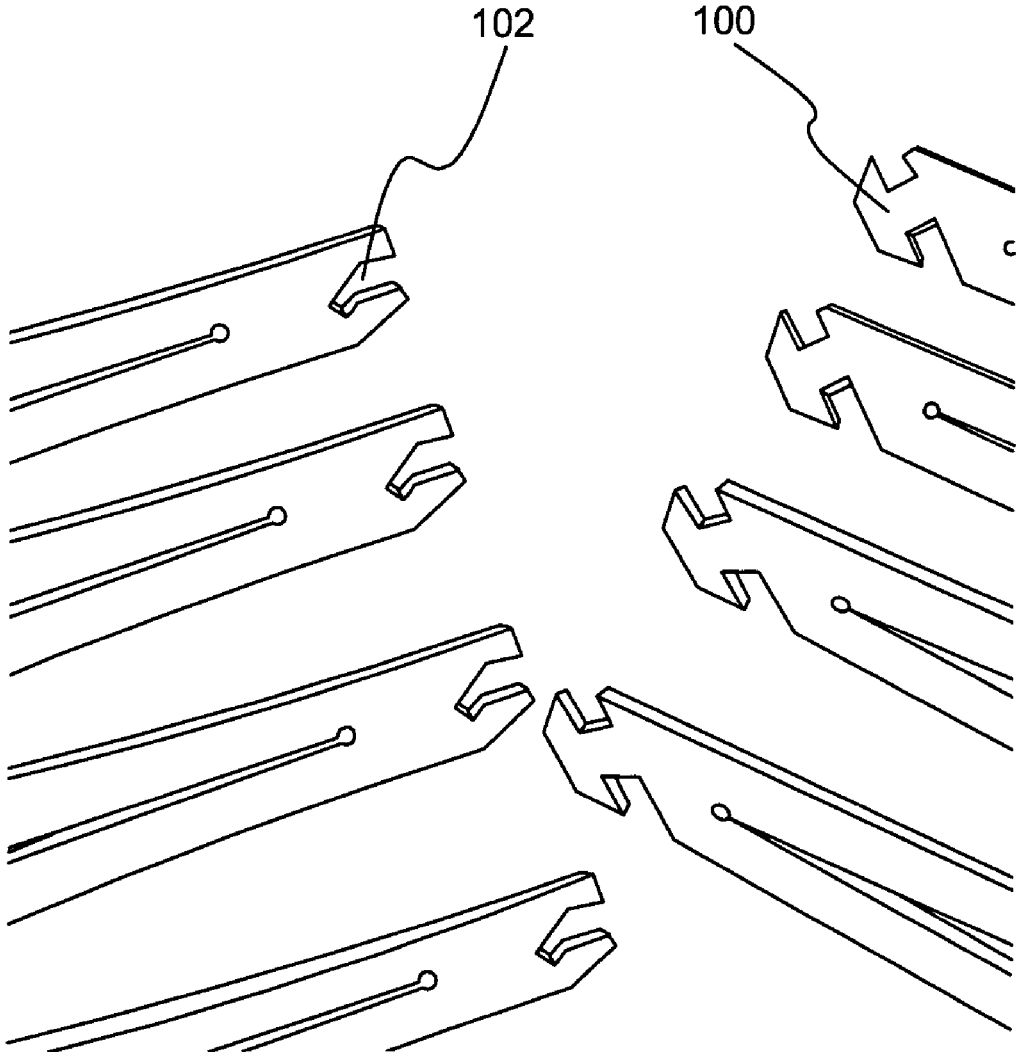
FIGS. 15A-15E are perspective views depicting fixing means in distal ends of the expandable panels used to fix expandable panels together.
Figure 15B:
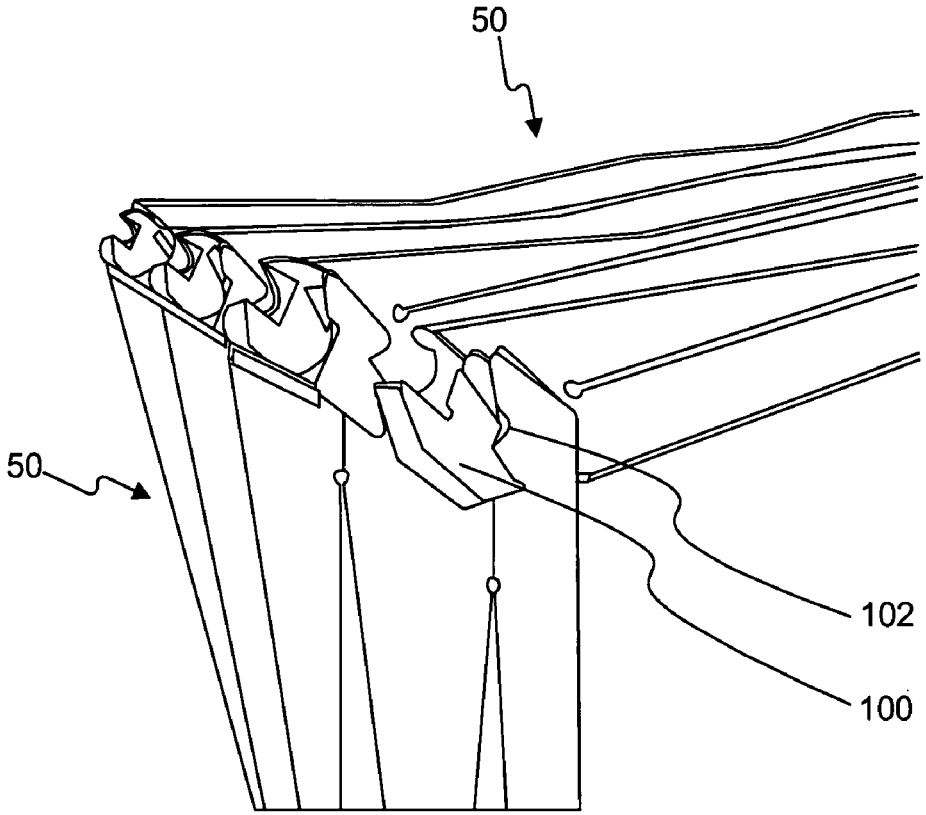
Figure 15C:
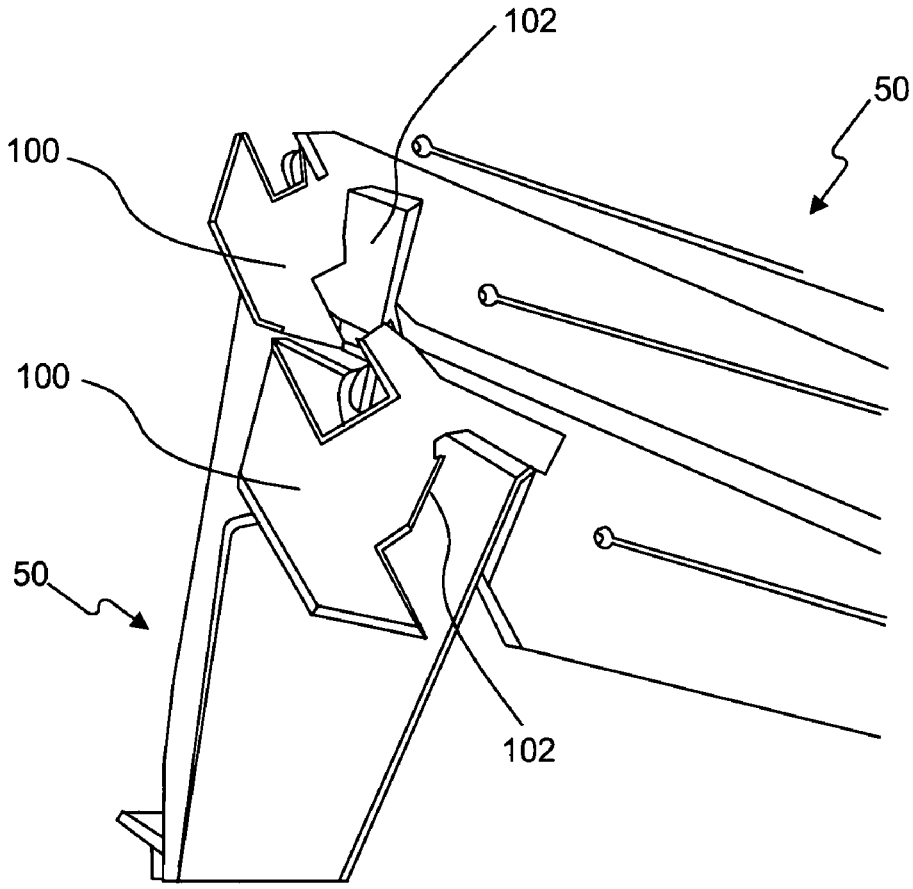
Figure 15D:
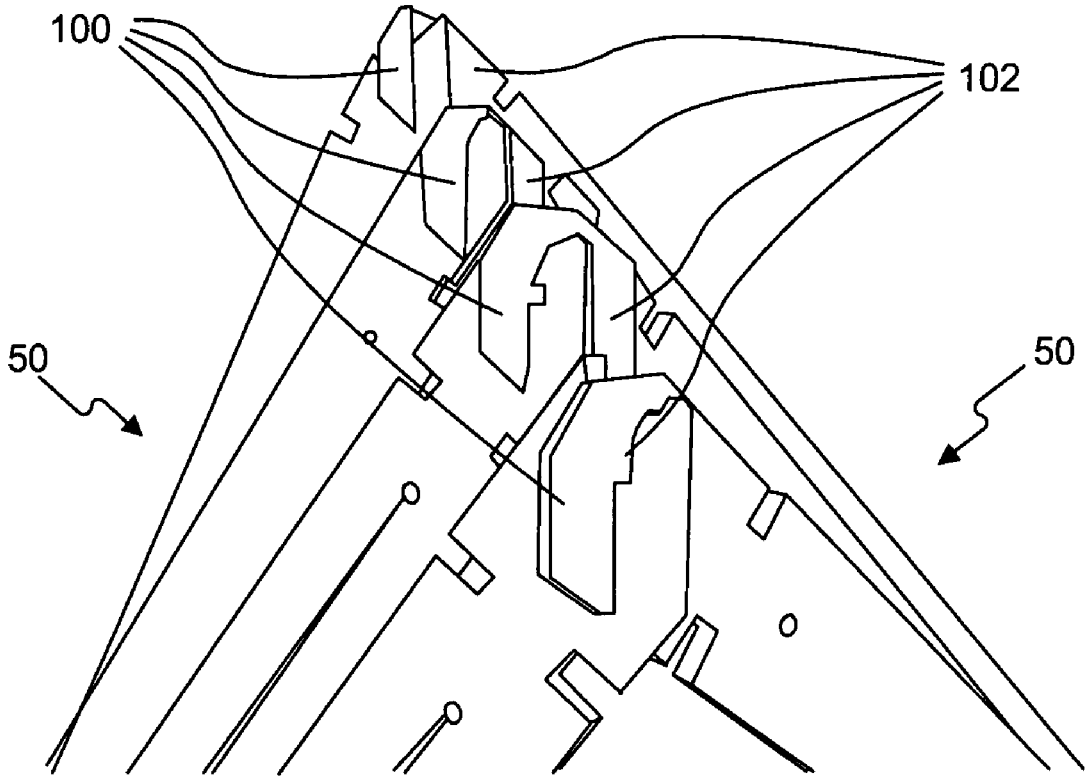
Figure 15E:
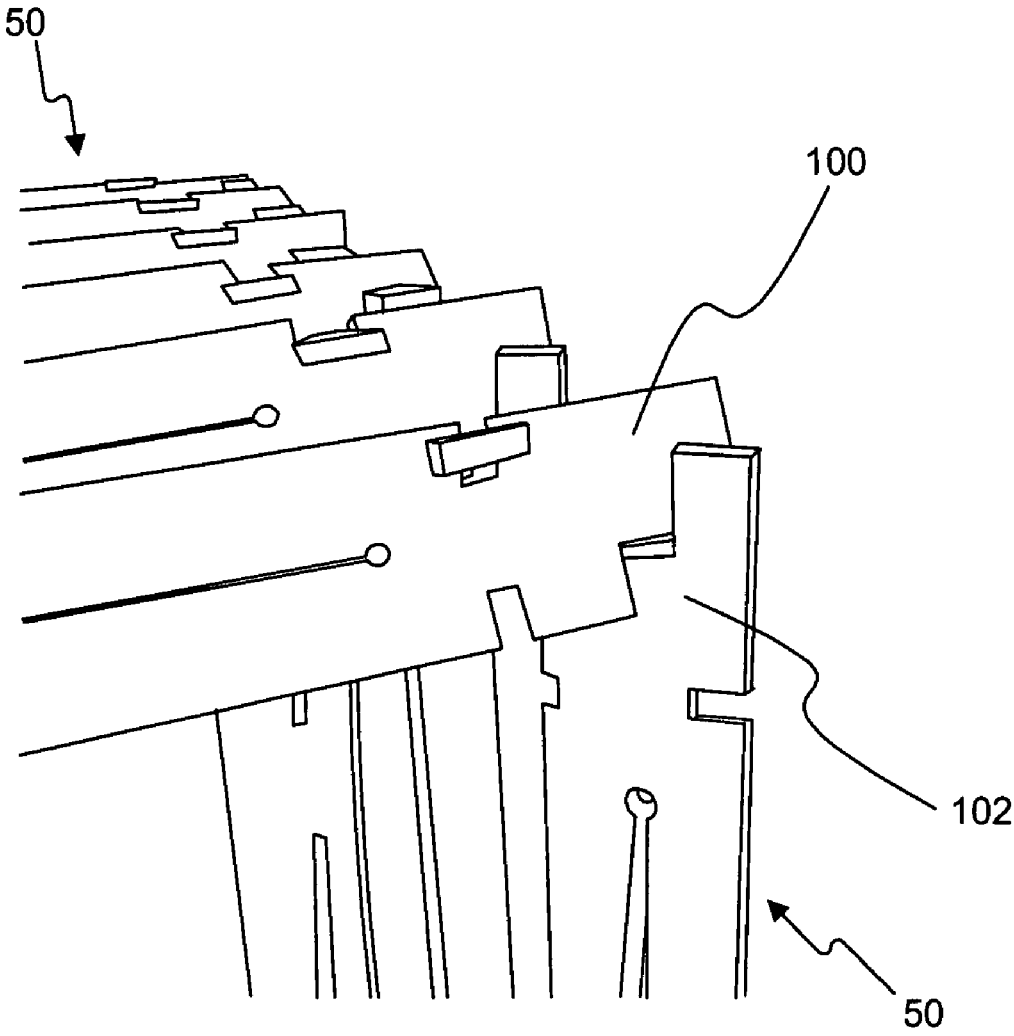

FIGS. 15A-E depict fixing means in distal ends of the expandable panels 50 for connecting expandable panels 50 together. Specifically, referring back to FIG. 2A, each first distal end joint 116 and/or second distal end joint 118 of each segment 110, 112, 114 may include a fixing means for connecting various modular expanded panels 50 together by their first and/or second distal ends 58, 59. As illustrated in FIG. 15A, each segment of the panel 50 may include at least one of a male connector 100 and a female receptor 102. As illustrated, the male connectors 100 and the female receptors 102 may be tongue and groove mechanisms that form mating engagements between the respective distal ends of the panels 50. FIGS. 15B-E illustrate embodiments in which the panels 50 are joined by the male connectors 100 and the female receptors 102. The panels 50 also may be joined to each other in various configurations by use of the tab portions 55. In these embodiments, already expanded and assembled panels 50 may be in modular form and therefore suitable for interconnection between themselves and other building components. Accordingly, the presently disclosed expandable panel 50 may become one component of a comprehensive and mass-produced modular building system.

The expandable panel 50, consistent with the present invention, may be manufactured from one or more of any suitable type of material. For example, expandable panels may be made out of plywood, such as birch, fir, meranti, or bamboo plywood. Plywood may be selected depending on various levels of quality, taking into consideration factors such as knots, gap widths between plys, glue quality, and supplier. Plywood may be selected having relatively thinner plys and high-quality glue in the interest of increased panel flexibility. Plywood that has a thickness of approximately 0.25" to 0.75" may be used depending on the nature of its use (e.g., interior versus exterior wall). In some embodiments, several sheets of thinner plywood may be layered to increase its load-bearing functionality. Moreover, plywood may be selected depending on grain orientation. In a preferred embodiment, plywood may be selected having wood grain running in a longitudinal axis of the expandable panel, in order to strengthen the panel against transverse bending.

Expandable panels also may be made from plastics such as polyethylene, polycarbonate, and the like. Expandable panels may, in some embodiments, be made from metals or metal alloys, including steel, stainless steel, and aluminum. In another embodiment, expandable panels may be made from composite materials, such as fiberglass, carbon fiber, or composites of plastics or wood. In a still further embodiment, expandable panels may be made from recycled materials of one or more of the aforementioned materials.

Methods for manufacturing expandable panels consistent with the present invention may include conventional and/or relatively advanced techniques. For example, any suitable technique may be selected depending on factors such as materials, costs, blank size, and time constraints. Expandable panels may be initially designed using a computer. For example, software operating on a computer, such as computer aided drafting ("CAD") software, may be used to create drawing files of preferable shapes for expandable panels. In some embodiments, CAD software may be used in combination with computer aided manufacturing ("CAM") software. Cutting paths and speeds may be input by a user on the computer or the cutting machine, or automatically generated by software operating on either device. In one embodiment, particularly designed cuts may be programmed using CAD modeling software. Resulting drawing files may be transferred to a cutting machine.

In one embodiment, expandable panel 50 may be manufactured by a CNC milling machine. By this embodiment, well-tested methods may be used to program and cut slots into the expandable panel 50. However, due to substantial material loss from a saw, sometimes as much as 0.5 inches, more advanced techniques may be desired. For example, in other embodiments, expandable panel 50 may be manufactured with a water jet-cutting machine or laser-cutting machine, both of which offer material loss approximately one-tenth (e.g., approximately 0.032" in certain water jet-cutting machines) of that experienced with CNC machines. Such precise manufacturing may be advantageous in embodiments of the present invention in which cuts and gaps approach relatively small dimensions. Moreover, reduced material loss may be desired when forming precise stress-propagation inhibiting features, such as at apertures 63, 65, 69, and 70. Expandable panel 50 also may be manufactured in mass-production by one or more radial dies.

Once manufactured and assembled, the exemplary expandable panel 50 may be oriented such that the cuts 60 extend either vertically or horizontally. For example, the expandable panel 50 may form a large wall section that extends from floor to ceiling. The expandable panel 50 may have formed therein spaces for elements such as windows and doors. In certain embodiments, the expandable panel 50 may be expanded by varying amounts at distinct locations along the length of the panel 50 to account for these features.

The characteristics and features of the presently disclosed exemplary expandable panel and assembly provide numerous advantages. For instance, in their unassembled (i.e., nonexpanded) position, numerous expandable panels 50 may be stacked in relatively lesser volume due to the initially flat sheet configuration of the panels 50. Accordingly, storage and shipping costs are reduced, and fewer trips are required for transporting building materials to the job site.

In addition, because the exemplary expandable panels 50 may be mass-produced in a machine shop or factory, and because they require little further assembly, relatively unskilled labor may be employed in the final stages of panel assembly and installation. For example, assembly may include a relatively simple method of snapping together panels and connectors without the need for material removal processes. Furthermore, use of the expandable panel 50 may be advantageous in applications requiring eventual un-installation since the panel 50 may be retracted and re-stored in its nonexpanded position. Therefore, the disclosed expandable panel 50 may be particularly well-suited for use in structures, such as emergency shelters, low-income housing, temporary barriers, signage, tents, stages, and pavilions. For example, a structure formed from the expandable panels 50 may be covered by a canvas tarpaulin or additional sheets of plywood with relative ease and cost-efficiency.

Moreover, because an assembly including the expandable panel 50 may be relatively flexible, a wall or other support including it may be particularly well-suited in applications subject to substantial vibrations, such as those in construction and earthquake zones. For example, upon selection of the appropriate materials and inclusion of particular stress-mitigating features, an earthquake-proof structure may be formed by assembly of one or more of the expandable panels 50.

Other embodiments of the invention will be apparent to those skilled in the art from consideration of the specification and practice of the invention disclosed herein. It is intended that the specification and examples be considered as exemplary only, with a true spirit and scope of the invention being indicated by the following claims. Thus, it should be understood that the invention is not limited to the illustrative examples in this specification. Rather, the invention is intended to cover all modifications and variations that come within the scope of the following claims and their equivalents.

What is claimed is:

1. A panel structure comprising:

a sheet of material configured to move between a nonexpanded position, wherein the sheet of material forms a substantially flat shape, and an expanded position, wherein the sheet of material forms a substantially stepped shape;

a first side segment formed in the sheet of material and having an outer leg and an inner leg configured to allow the first side segment to bow when the sheet of material moves from the nonexpanded position to the expanded position;

a second side segment formed in the sheet of material and having an outer leg and an inner leg configured to allow the second side segment to bow when the sheet of material moves from the nonexpanded position to the expanded position;

an inner segment formed in the sheet of material and having a first leg and a second leg configured to allow the inner segment to bow when the sheet of material moves from the nonexpanded position to the expanded position; and a spacer configured to maintain the sheet of material in the expanded position.

2. The panel structure of claim 1, wherein each of the first side segment, second side segment, and inner side segment includes a first distal end joint and a second distal end joint; and both legs of each segment are joined to each other at their ends by a corresponding first distal end joint and second distal end joint.

3. The panel structure of claim 2, wherein the first distal end joints and second distal end joints are subjected to one or more of bending, compression, and torsion when the panel is in an expanded position.

4. The panel structure of claim 2, wherein at least one of the first distal end joint and second distal end joint of each segment comprises a male connector and a female receptor, each configured to join a plurality of panels by their first distal end joints or second distal end joints.

5. The panel structure of claim 1, wherein each of the legs includes a midpoint portion, the inner leg of the first side segment and a first leg of at least one inner segment are joined by their respective midpoint portions, and the inner leg of the second side segment and a second leg of at least one inner segment are joined by their respective midpoint portions.

6. The panel structure of claim 5, wherein the midpoint portions are subjected to one or more of bending, compression, and torsion when the panel is in the expanded position.

7. The panel structure of claim 1, wherein each of the legs includes at least part of a first panel surface and at least part of a second panel surface, wherein the first panel surface substantially faces the adjacent second panel surface when the panel is in the nonexpanded position, and the first panel surface is spaced apart from the second panel surface when the panel is in the expanded position.

8. The panel structure of claim 7, wherein the first panel surface and the second panel surface are each subjected to one or more of bending, compression, and torsion when the panel is in the expanded position.

9. The panel structure of claim 8, wherein the first and second panel surfaces define front and rear planes, respectively, which are configured to support sheathing on opposite sides of the panel when the panel is in the expanded position.

10. The panel structure of claim 1, wherein the inner legs, outer legs, first legs, and second legs are spread apart from adjacent legs to define a substantially stepped shape when the panel is in the expanded position.

11. The panel structure of claim 1, wherein the sheet of material includes a first set of substantially parallel apertures extending along a first direction and a second set of substantially parallel grooves extending along a second direction substantially perpendicular to the first direction.

12. The panel structure of claim 11, wherein the at least one spacer is fitted within at least one of the second set of substantially parallel grooves.

13. The panel structure of claim 1, wherein the at least one spacer includes a first slot extending along a first direction and a second slot extending along a second direction substantially opposite to the first direction.

14. A method of forming a wall structure comprising:

providing a panel having a substantially planar portion having front and rear surfaces, right and left side edges, and first and second distal ends, with a central portion defined midway;

forming a plurality of spaced substantially parallel apertures through the panel portion from the front surface to the rear surface so as to define a pair of first and second panel surfaces facing each other;

pulling the panel in opposite directions by the right and left side edges, thereby spreading apart the panel along each cut, with the panel portions between the cuts bending apart to define a substantially stepped shape haying front and rear planes;

using a spacer to secure the panel in its expanded position; and affixing sheathing to at least one of the front and rear planes of the panel.

15. The method of claim 14, further comprising connecting a plurality of the panels together by joining one or more of their front and rear surfaces, right and left side edges, and first and second distal ends.

16. The method of claim 14, wherein the securing step includes inserting connectors between adjacent parallel apertures to hold the panel in the expanded position.

17. The method of claim 14, wherein the securing step includes inserting one or more skin panels into one or more apertures of the panel.

18. The method of claim 17, wherein the securing step further includes affixing the skin panels to one or more pairs of edges facing each other.

19. The method of claim 14, wherein the affixing step includes hanging sheathing from one or more of the first and second panel surfaces.

20. The method of claim 14, wherein the affixing step includes hanging sheathing from both the front and rear planes of the panel.

21. The method of claim 20, further comprising pouring concrete between sheathing hung from the front and rear planes of the panel.

22. The method of claim 20, further comprising installing insulation between sheathing hung from the front and rear planes of the panel.

23. An expandable panel structure comprising:

a substantially planar portion having front and rear surfaces, right and left side edges, and first and second distal ends, with a central portion;

a plurality of spaced substantially parallel cuts penetrating the panel portion from the front surface to the rear surface;

the plurality of spaced substantially parallel cuts including a first plurality of cuts spaced a predetermined distance apart, each cut of the first plurality of cuts extending from the first distal end to an aperture provided in the panel at a position spaced away from the central portion toward the first distal end, thereby defining a first plurality of apertures substantially aligned with one another;

the plurality of spaced substantially parallel cuts further including a second plurality of spaced substantially parallel cuts, each cut of the second plurality of cuts extending from the second distal end to an aperture provided in the panel at a position spaced away from the central portion toward the second distal end, thereby defining a second plurality of apertures substantially aligned with one another, each respective cut in the second plurality of cuts being substantially aligned with a corresponding cut in the first plurality of cuts;

the plurality of cuts further including a third plurality of cuts spaced from one another between the aligned first and second pluralities of cuts, each cut of the third plurality of cuts extending between an aperture of a third plurality of apertures and an aperture of a fourth plurality of apertures, the third and fourth pluralities of apertures being spaced inward from the first and second distal ends toward the central portion, each of the cuts defining a pair of edges that face each other; and wherein the panel is configured to expand between a nonexpanded, substantially flat shape and an expanded, substantially stepped shape, by moving the right and left side edges in opposite directions so as to spread apart portions of the panel along each cut and bend the panel portions between the cuts apart to define front and rear planes, and by securing the panel in the expanded, substantially stepped shape by affixing a spacer in one of the plurality of cuts.

24. The expandable panel structure of claim 23, wherein each cut of the first plurality of cuts further includes a first gap extending substantially transversely across the cut at a position spaced from the first distal end toward the central portion, the plurality of gaps in the first plurality of cuts being substantially aligned with one another.

25. The expandable panel structure of claim 23, wherein each cut of the second plurality of cuts further includes a second gap extending substantially transversely across the cut at a position spaced from the second distal end toward the central portion, the plurality of gaps in the second plurality of cuts being substantially aligned with one another.

26. The expandable panel structure of claim 23, wherein each cut in the third plurality of cuts includes a gap generally transverse to the cut proximate the central portion, wherein the gaps in the third plurality of cuts substantially align with one another.

27. A panel structure comprising:

a panel assembly having a pattern of cuts, a pattern of grooves, and a pattern of apertures configured to move the panel assembly between a nonexpanded position, where the panel assembly forms a substantially flat shape, and an expanded position, where the panel assembly forms a substantially stepped shape; and a support structure configured to fit within at least one of the pattern of grooves of the panel assembly and maintain the panel assembly in the expanded position.

28. The panel structure of claim 27, wherein the support structure includes a plurality of connectors each configured to fit within one of the pattern of grooves so as to maintain the panel assembly in the expanded position.

29. The panel structure of claim 27, wherein the panel assembly includes a first surface, a second surface, and a protrusion; the panel assembly is configured to move between the nonexpanded position, wherein the first and second surfaces of the panel assembly face one another and are adjacent to one another, and the expanded position, wherein the first and second surfaces of the panel assembly are spaced apart from one another; and the support structure includes a tab configured to fit the protrusion of the panel assembly.

30. The panel structure of claim 27, wherein the panel assembly comprises a first sheet of material having a male connector and a second sheet of material having a female receptor configured to fit the male connector of the first sheet of material.

31. The panel structure of claim 30, wherein the male connector is located at an upper distal end of the first sheet of material and the female receptor is located at a lower distal end of the second sheet of material.

32. The panel structure of claim 31, wherein when the panel assembly is in the expanded position, the first sheet of material forms a wall unit and the second sheet of material forms a ceiling unit.

33. The panel structure of claim 27, wherein the panel assembly forms a wall unit and a ceiling unit when it is in the expanded position.

34. The panel structure of claim 27, wherein the panel assembly forms one or more of an arched wall, arched canopy, or barrel vault.

35. The panel structure of claim 27, wherein the panel assembly includes a first sheet of material configured to move between the nonexpanded and expanded positions, and a second sheet of material configured to be attached to the first sheet of material when it is in the expanded position.

36. The panel structure of claim 35, wherein the first sheet of material includes a tab configured to fit within an aperture of the second sheet of material when the first sheet of material is in the expanded position.

* * * * *

UNITED STATES PATENT AND TRADEMARK OFFICE

CERTIFICATE OF CORRECTION

PATENT NO. : 7,803,466 B2
APPLICATION NO. : 11/783238
DATED : September 28, 2010
INVENTOR(S) : Sean C. Dorsy It is certified that error appears in the above-identified patent and that said Letters Patent is hereby corrected as shown below:

Claim 14, col. 14, line 62, "haying" should read -- having --.

Signed and Sealed this

Twenty-first Day of December, 2010

David J. Kappos

David J. Kappos
*Director of the United States Patent and Trademark Office*